US006992241B2

(12) United States Patent
Fujiwara

(10) Patent No.: US 6,992,241 B2
(45) Date of Patent: Jan. 31, 2006

(54) AUTOMATIC PLAYER MUSICAL INSTRUMENT FOR EXACTLY REPRODUCING PERFORMANCE AND AUTOMATIC PLAYER INCORPORATED THEREIN

(75) Inventor: Yuji Fujiwara, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/992,328

(22) Filed: Nov. 17, 2004

(65) Prior Publication Data

US 2005/0145087 A1 Jul. 7, 2005

(30) Foreign Application Priority Data

Dec. 25, 2003 (JP) ..... 2003-428990

(51) Int. Cl.
*G10F 1/02* (2006.01)

(52) U.S. Cl. ..... 84/21; 84/115; 84/462

(58) Field of Classification Search ..... 84/21, 84/115, 461, 462
See application file for complete search history.

(56) References Cited

U.S. PATENT DOCUMENTS 4,970,928 A * 11/1990 Tamaki ..... 84/21
5,131,306 A 7/1992 Yamamoto
5,451,708 A * 9/1995 Fujiwara et al. ..... 84/21
5,652,399 A 7/1997 Fujiwara et al.
6,051,762 A * 4/2000 Fujiwara et al. ..... 84/21

FOREIGN PATENT DOCUMENTS

JP 2-275991 11/1990
JP 7-175472 7/1995

* cited by examiner

*Primary Examiner*—Jeffrey W Donels
(74) *Attorney, Agent, or Firm*—Morrison & Foerster, LLP

(57) ABSTRACT

An automatic player piano has a feedback control loop for each of the black/white keys; the controller firstly determines a reference trajectory, i.e., a target key position varied with time for each key to be moved in the play-back, and calculates a target key velocity, and compares a true key position reported from a key sensor and a true key velocity calculated from the true key position with the target key position and target key velocity for optimizing the duty ratio of the driving signal; the positional difference and the velocity difference are independently multiplied by a positional gain and a velocity gain so as to determine the optimum duty ratio; since the ratio of the velocity gain to the positional gain is 1 to 3, the key travels along the reference trajectory without oscillation and overshoot.

21 Claims, 13 Drawing Sheets

| kx \ kv | 0.0 | 0.2 | 0.5 | 0.8 | 1.1 | 1.4 | 1.7 | 2.0 | 2.3 | 2.6 | 2.9 | 3.2 | 3.5 |
|---|---|---|---|---|---|---|---|---|---|---|---|---|---|
| 0.0 | * | | | | | | | | | | * | # | # |
| 0.2 | * | * | * | * | * | * | * | * | * | * | * | # | |
| 0.5 | + | + | ok | ok | ok | − | * | * | * | # | # | # | |
| 0.8 | + | + | + | + | ok | ok | ok | ok | ok | − | | | |
| 1.1 | | | | + | + | ok | ok | ok | ok | # | | | |
| 1.4 | | | | | + | + | + | ok | ok | # | | | |
| 1.7 | | | | | | + | + | ok | ok | # | | | |
| 2.0 | | | | | | | + | ok | # | | | | |
| 2.3 | | | | | | | + | + | # | | | | |

Mark "*" means that any tone was not generated.
Mark "+" means that the tone was larger in loudness than the original tone was.
Mark "ok" means that the tone was almost as large in loudness as the original tone was.
Mark "-" means that the tone was smaller in loudness than the original tone was.
Mark "#" means that the key motion was unstable due to the oscillation, by way of example.

Fig. 10

AUTOMATIC PLAYER MUSICAL INSTRUMENT FOR EXACTLY REPRODUCING PERFORMANCE AND AUTOMATIC PLAYER INCORPORATED THEREIN

FIELD OF THE INVENTION

This invention relates to controlling technologies for manipulators of a musical instrument and, more particularly, to an automatic player musical instrument and an automatic player incorporated therein.

DESCRIPTION OF THE RELATED ART

An automatic player piano is a typical example of the musical instrument with a built-in automatic player. The automatic player or automatic playing system makes it possible to play a piece of music on the piano without any fingering of a human player. The automatic playing system is usually broken down into an array of key actuators, a controller and position transducers. Music data codes are sequentially analyzed by the controller. The controller analyzes the music data codes, and determines the time to start the key motion and reference trajectories for the keys to be moved. When the time comes, the controller supplies a driving pulse signal to the key actuator associated with the key to be moved, and causes the key to travel along the reference trajectory through the servo control by means of the position transducer.

A typical example of the feedback control is disclosed in Japanese Patent Application laid-open No. Hei 7-175472, which is hereinafter referred to as "first prior art". Japanese Patent Application No. Hei 5-344241 was published as the Japanese Patent Application laid-open, and had offered the convention priority right to the U.S. Patent Application , on which U.S. Pat. No. 5,652,399 was granted. The controller takes the current key position into account during the feedback control. The controller compares the current key position, i.e., the actual keystroke with the target key position on the reference trajectory, i.e., the target keystroke, and varies the duty ratio of the driving pulse signal in order to accelerate or decelerate the key. The Japanese Patent Application laid-open further teaches that the key motion is controllable through comparison between the actual key velocity and the target key velocity on the reference trajectory.

Since the loudness of the tones is proportional to the final hammer velocity at the impact on the strings, the automatic playing system is expected to control the hammer velocity through the key velocity. The final hammer velocity is roughly proportional to the key velocity at the reference point on the reference trajectory. This means that the loudness is controllable by means of the key actuators. The reference point is 9.0–9.5 millimeters lower than the keys at the rest positions in standard acoustic pianos. For this reason, most of the description in the first prior art is made on the feedback control on the keys through the elimination of the difference from between the actual keystroke and the target keystroke.

Another example of the feedback control is disclosed in Japanese Patent Application laid-open No. Hei 2-275991, which is hereinafter referred to as "second prior art". Japanese Patent Application No. 2-9551 had been filed on the basis of Japanese Patent Application No. Hei 1-10176 under the claim on the domestic priority right, and was published as Japanese Patent Application laid-open No. Hei 2-275991.

Japanese Patent Application No. Hei 1-10176 had offered the convention priority right to the U.S. Patent Application, which resulted in U.S. Pat. No. 5,131,306.

The prior art feedback control is applied to the pedal system incorporated in the acoustic piano. The pedals are controlled with the PWM (Pulse Width Modulated) signal, and the duty ratio of the PWM signal is regulated to a proper value through the feedback control on the basis of the pedal position. However, when the player rapidly depresses the pedal, the feedback loop requires a large gain, which is causative of the hunting. In order to prevent the feedback loop from the hunting, it is proposed to correct the duty ratio with the pedal velocity. The second prior art further teaches that the individualities of the piano components are taken up through the normalization.

As described hereinbefore, it is important to adjust the actual key velocity to the target key velocity at the reference point. However, the controller increases or decreases the duty ratio of the driving pulse signal for eliminating the difference from between the actual keystroke and the target keystroke. In other words, the key velocity is merely indirectly controlled in the first prior art. Another reason for the inconsistency is a small value of the feedback gain. If the feedback gain is increased, oscillation and overshoot are liable to take place. In order to prevent the feedback loop from these undesirable phenomena, the feedback gain is merely given to the feedback loop. As a result, the actual key hardly follows the target key, and the actual key velocity at the reference point tends to be inconsistent with the target key velocity at the reference point.

The correction with the pedal velocity and normalization are taught in the second prior art. The correction technique makes it possible to enlarge the feedback gain without the oscillation and overshoot. This means that the pedal motion is exactly reproduced through the feedback loop disclosed in the second prior art.

Although the pedals are exactly put at the target pedal position through the feedback control technique disclosed in the second reference, it is difficult to apply the feedback control technique disclosed in the second reference to the key actuators. The first reason for the difficulty is that the position control is not expected but the velocity control is expected in the key actuators. The feedback control technique and normalization technique disclosed in the second prior art are hardly applied to the key actuators as they are. Another reason for the difficulty is the difference in load to be controlled. The pedal actuators are large and heavy, and are moved slowly. On the other hand, the key actuators are small and light, and the keys are complicatedly moved between the rest positions and the end positions at high speed. Moreover, the keys and associated parts are liable to be deformed, and noise tends to be introduced into the signals and the pieces of music data. Thus, even if the feedback control technique disclosed in the second reference is applied to the automatic playing system disclosed in the first reference, the target velocity is hardly imparted at the reference point.

SUMMARY OF THE INVENTION

It is therefore an important object of the present invention to provide an automatic player, which makes manipulators of a musical instrument exactly travel on reference trajectories.

It is also an important object of the present invention to provide a musical instrument, which is equipped with the automatic player.

To accomplish the object, the present invention proposes to adjust a gain to be applied to a positional difference and another gain to be applied to a velocity difference to proper values fallen within a predetermined numerical range.

In accordance with one aspect of the present invention, there is provided an automatic player musical instrument for producing tones comprising an acoustic musical instrument including a tone generating sub-system for producing the tones and plural motion propagating paths each having plural component parts connected in series to one another toward the tone generating sub-system and sequentially moved for specifying a pitch of the tone to be produced, and an automatic playing system including plural sensors respectively converting motion of predetermined component parts respectively incorporated in the plural motion propagating paths to detecting signals representative of a current physical quantity expressing the motion, a target state indicator for producing pieces of target data each representative of a target physical quantity and a rate of change of the target physical quantity for one of the predetermined component parts, plural actuators respectively associated with the plural motion propagating paths and selectively energized with driving signals so as selectively to cause the associated motion propagating paths to move and plural feedback control loops connected between the plural sensors and the plural actuators and optimizing the driving signals; each of the plural feedback loops has a first data processor connected to one of the plural sensors and determining a true physical quantity and a rate of change of the true physical quantity on the basis of the current physical quantity, a second data processor connected to the target state indicator and the first data processor and determining a first difference between the target physical quantity and the true physical quantity and a second difference between the rate of change of the target physical quantity and the rate of change of the true physical quantity, a multiplier connected to the second data processor and respectively multiplying the first difference and the second difference by a first gain and a second gain so as to produce a first controlling signal and a second controlling signal, respectively and a signal modulator connected between the multiplier the plural actuators and optimizing the driving signal on the basis of the first controlling signal and the second controlling signal; the first gain is fallen within a range between 0.5 and 2.0, the second gain is fallen within a range between 0.5 and 2.3, and the ratio of the second gain to the first gain ranges from 1 to 3.

In accordance with another aspect of the present invention, there is provided an automatic player associated with a musical instrument comprising plural sensors respectively converting motion of predetermined component parts of plural motion propagating paths incorporated in the musical instrument to detecting signals representative of a current physical quantity expressing the motion, a target state indicator for producing pieces of target data each representative of a target physical quantity and a rate of change of said target physical quantity for one of the predetermined component parts, plural actuators respectively associated with the plural motion propagating paths and selectively energized with driving signals so as selectively to cause the associated motion propagating paths to move for producing tones, and plural feedback control loops connected between the plural sensors and the plural actuators and optimizing the driving signals; each of the plural feedback loops has a first data processor connected to one of the plural sensors and determining a true physical quantity and a rate of change of the true physical quantity on the basis of the current physical quantity, a second data processor connected to the target state indicator and the first data processor and determining a first difference between the target physical quantity and the true physical quantity and a second difference between the rate of change of the target physical quantity and the change of rate of the true physical quantity, a multiplier connected to the second data processor and respectively multiplying the first difference and the second difference by a first gain and a second gain so as to produce a first controlling signal and a second controlling signal, respectively, and a signal modulator connected between the multiplier and the plural actuators and optimizing the driving signal on the basis of the first controlling signal and the second controlling signal; the first gain is fallen within a range between 0.5 and 2.0, the second gain is fallen within a range between 0.5 and 2.3, and the ratio of the second gain to the first gain ranges from 1 to 3.

BRIEF DESCRIPTION OF THE DRAWINGS

The features and advantages of the method, computer program, automatic player and musical instrument will be more clearly understood from the following description taken in conjunction with the accompanying drawings, in which FIG. 10 is a table showing an optimum range of the gains determined through the experiments.

DESCRIPTION OF THE PREFERRED EMBODIMENTS

In the following description, term "front" is indicative of a position closer to a human player, who is sitting on a stool for fingering, than a position modified with term "rear". A line, which is drawn between a front position and a corresponding rear position, extends in "fore-and-aft direction", and the fore-and-aft direction crosses "lateral direction" at right angle.

First Embodiment

Automatic Player Piano

Figure 1:
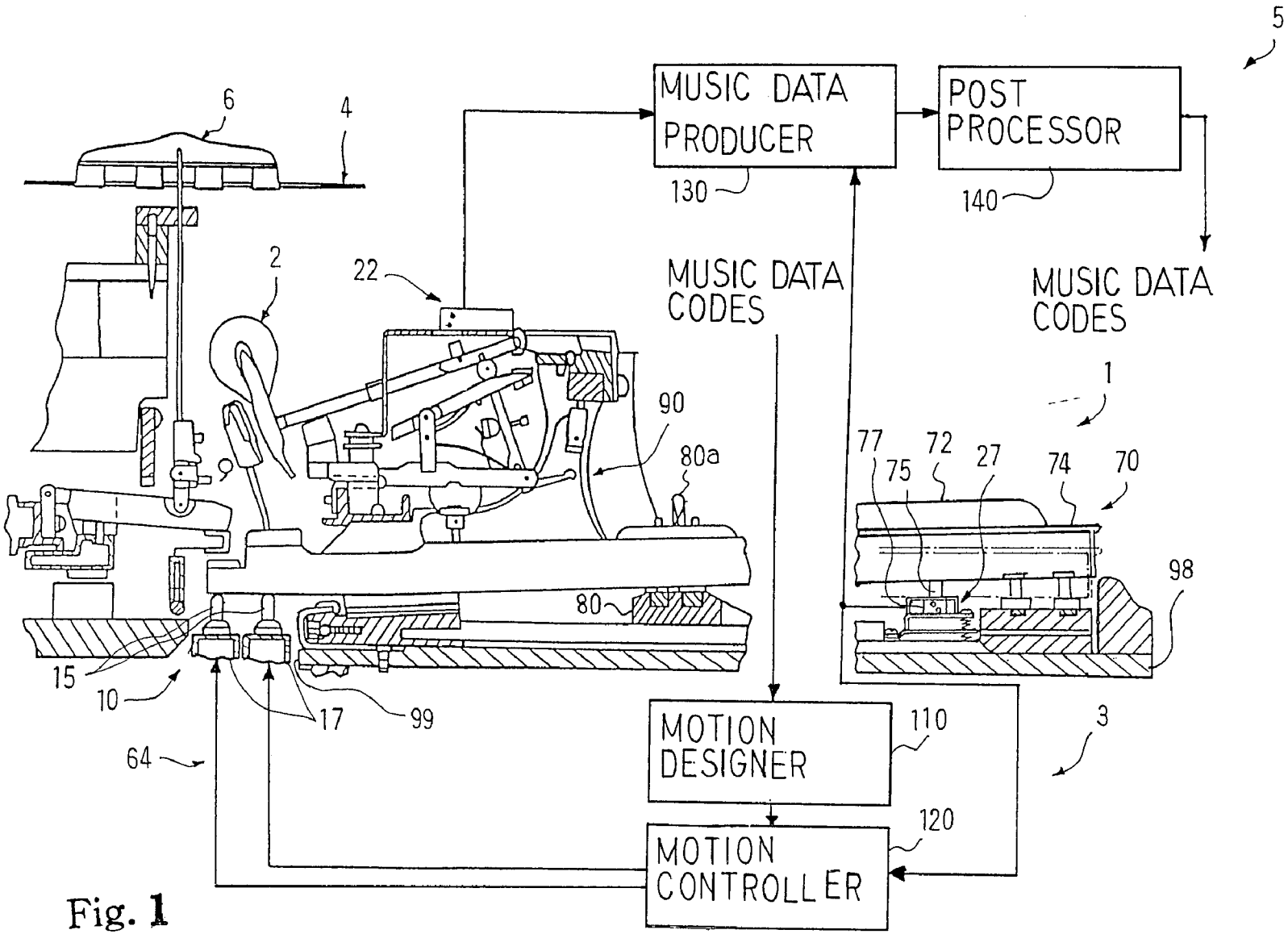
FIG. 1 is a side view showing the structure of an automatic player piano according to the present invention.

Referring to FIG. 1 of the drawings, an automatic player piano embodying the present invention largely comprises an acoustic piano 1, an automatic playing system 3 and a recording system 5. The automatic playing system 3 and recording system 5 are installed in the acoustic piano 1, and are selectively activated depending upon the mode of operation. While a player is fingering a piece of music on the acoustic piano 1 without any instruction for recording and playback, the acoustic piano 1 behaves as similar to a standard acoustic piano, and generates the piano tones at the pitches specified through the fingering.

When the player wishes to record his or her performance on the acoustic piano 1, the player gives the instruction for the recording to the recording system 5, and the recording system 5 is activated. While the player is fingering on the acoustic piano, the recording system 5 produces music data codes representative of the fingering on the acoustic piano 1, and the performance is recorded in a set of music data codes.

A user is assumed to wish to reproduce the performance. The user instructs the automatic playing system 3 to reproduce the acoustic tones. The automatic playing system 3 fingers the piece of music on the acoustic piano 1, and reenacts the piece of music without the fingering of the human player.

The acoustic piano 1, automatic playing system 3 and recording system 5 are hereinafter described in detail.

Acoustic Piano

In this instance, the acoustic piano 1 is a grand piano. The acoustic piano 1 includes hammers 2, strings 4, dampers 6, a keyboard 70 and action units 90. A key bed 98 forms a part of a piano cabinet, and the keyboard 70 is mounted on the key bed 98. The keyboard 70 is linked with the action units 90 and dampers 6, and a pianist selectively actuates the action units 90 and dampers 6 through the keyboard 70. The dampers 6, which have been selectively actuated through the keyboard 70, are spaced from the associated strings 4 so that the strings 4 get ready to vibrate. On the other hand, the action units 90, which have been selectively actuated through the keyboard 70, give rise to free rotation of the associated hammers 2, and the hammers 2 strike the associated strings 4 at the end of the free rotation. Then, the strings 4 vibrate, and the acoustic tones are produced through the vibrations of the strings 4. Thus, the keyboard 70, action units 90, dampers 6, hammers 2 and strings 4 behave as similar to those of a standard acoustic piano.

The keyboard 70 includes plural black keys 72, plural white keys 74 and a balance rail 80. The black keys 72 and white keys 74 are laid on the well-known pattern, and are movably supported on the balance rail 80 by means of balance key pins 80*a*.

A user is assumed to depress the front portions of the black and white keys 72/74. The front portions are sunk toward the key bed 98, and the rear portions are raised. The key motion gives rise to the activation of the associated key action units 90, and causes the strings 4 to get ready for the vibrations as described hereinbefore. The activated action units 90 drive the associated hammers 2 for the free rotation through the escape. The hammers 2 strike the associated strings 4 at the end of the free rotation for producing the acoustic tones. The hammers 2 rebound on the strings 4, and are dropped onto the key action units 90, again.

When the user releases the black and white keys 72/74, the self-weight of the action units 90 gives rise to the rotation of the black and white keys 72/74 in the counter direction so that the black and white keys 72/74 return to the rest positions. The dampers 6 are brought into contact with the associated strings 4 so that the acoustic tones are decayed. The key action units 90 return to the rest positions, again. Thus, the human pianist can give rise to the angular key motion about the balance rail 80*a* like a seesaw.

Automatic Playing System

Figure 2:
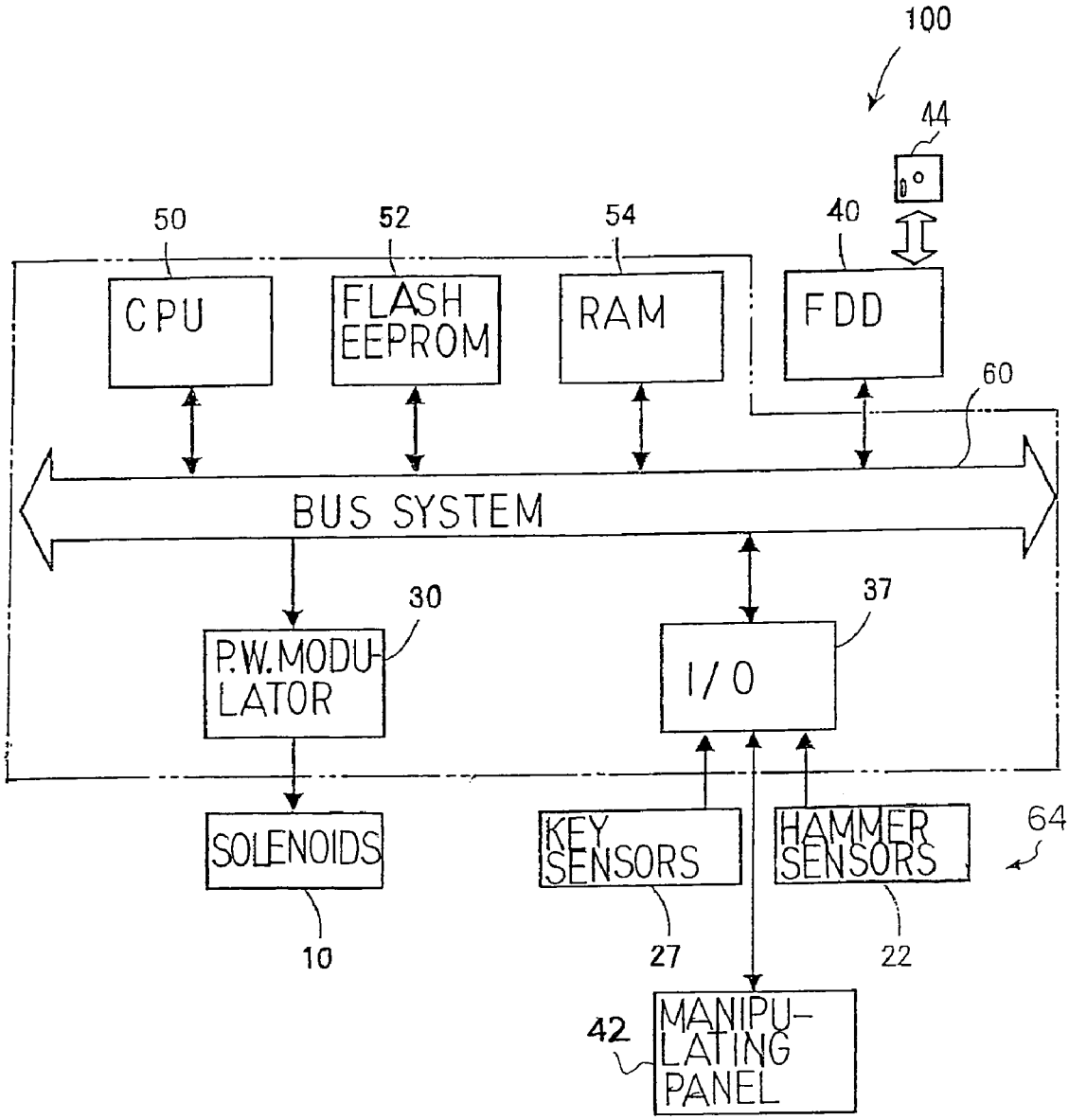
FIG. 2 is a block diagram showing the system configuration of a controller incorporated in the automatic player piano.

Description is hereinafter made on the automatic playing system 3 with reference to FIG. 2 concurrently with FIG. 1. The automatic playing system 3 includes an array of key actuators 10, hammer sensors 22, key sensors 27, a flexible disk driver, which is abbreviated as "FDD", 40, a manipulating panel 42 and a controller 100. As will be described hereinafter in conjunction with the recording system 5, those component parts are shared with the recording system 5 except the array of key actuators 10. In this instance, the key actuators 10 are implemented by solenoid-operated actuator units. The key actuators 10 are independently energized for moving the associated black and white keys 72/74. This means that the key actuators 10 to be required is equal in number to the black and white keys 72/74.

Each of the solenoid-operated key actuator units 10 includes a plunger 15 and a combined structure of a solenoid and yoke 17. The array of solenoid-operated key actuator units 10 is hung from the key bed 98, and the plungers 15 project over the key bed 98 through a slot 99 formed in the key bed 98. While the solenoid-operated key actuator units 10 is standing idle without any driving signal, the plungers 15 are retracted in the combined structure of solenoid and yoke 17, and the tips of the plungers 15 are slightly spaced from the lower surfaces of the black and white keys 72/74 at the rest positions. When the controller 100 energizes the combined structures 17 with the driving signal, magnetic field is created, and the magnetic force is exerted on the plungers 15. Then, the plungers 15 upwardly project from the combined structures 17, and pushes the lower surfaces of the black and white keys 72/74 so as to give rise to the angular motion.

The controller 100 includes a pulse width modulator 30, an interface 37, which is abbreviated as "I /O" in the figure, a central processing unit 50, which is abbreviated as "CPU", a flash electrically erasable and programmable read only memory 52, which is abbreviated as "FLASH EEPROM", a random access memory 54, which is abbreviated as "RAM" and a bus system 60. These system components 30, 37, 50, 52 and 54 are connected to the bus system 60, and address codes, control data codes and music data codes are selectively propagated from particular system components to other system components through the bus system 60.

The hammer sensors 22, key sensors 27 and manipulating panel 42 are connected to the interface 37, and the pulse width modulator 30 distributes the driving signal to the solenoid-operated key actuators 10. The flexible disk driver 40 is further connected to the bus system 60, and music data codes are transferred between the bus system 60 and the flexible disk driver 40.

The hammer sensors 22 are respectively provided for the hammers 2, that is, they are equal in number to the hammers 2, and, accordingly, the black and white keys 72/74. The hammer sensors 22 are stationary, and monitor the associated hammers 2. Each of the hammer sensors 22 includes two photo couplers, and each of the photo couplers is the combination of a light emitting diode and a phototransistor. The light emitting diodes are spaced from each other along the trajectory of a shutter plate attached to the hammer shank of the associated hammer 2, and are opposed to the phototransistors, respectively. Thus, the two pairs of photo couplers bridge the gap, through which the shutter plate is moved, with light beams.

One of the photo couplers is located at the end of the trajectory where the shutter plate begins to return due to the rebound of the hammer 2 on the associated string 4. Thus, the timing at which the hammers 2 strike the associated strings 4 is detected with the photo coupler on the downstream side. The other photo coupler is provided on the upstream side, and is spaced by a predetermined distance.

While the hammer 2 is rotating, the shutter plate intermittently intersects the light beams. The amount of light received by the phototransistors is rapidly changed, and digital hammer position signals, which the phototransistors produce on the basis of the amount of light received, are sequentially changed from on-state to off-state. The controller 100 measures the time lug, and the distance between the photo couplers is known. Then, the controller 100 determines the hammer velocity. The hammer velocity is proportional to the strength of the impact on the string 4, and the strength of the impact is proportional to the loudness of the acoustic tone. Thus, the controller 100 produces pieces of music data representative of the loudness of an acoustic tone and the time at which the acoustic tone is to be produced on the basis of the hammer position signals.

The key sensors 27 are provided on the key bed 98, and are respectively located below the black and white keys 72/74. This means that the key sensors 27 are equal in number to the black and white keys 72/74. The key sensors 27 converts current key positions of the associated black and white keys 72/74 to key position signals. Thus, the key sensors 27 serve as position transducers.

Each of the key sensors 27 includes a shutter plate 75, a non-transparent gray scale of which is printed on a transparent plate, and a pair of optical sensor heads 77. A light emitting diode (not shown) is connected to one of the optical sensor heads 77 through an optical fiber (not shown), and laterally radiates a light beam across the trajectory of the shutter plate 75. The other optical sensor head 77 is provided on the other side across the trajectory, and is connected to a phototransistor (not shown) through an optical fiber (not shown). The light beam has a wide cross section so that the shutter plate 75 gradually interrupts the light beam during the downward motion of the associated key 72/74. While the black and white key 72/74 is moving from the rest position toward the end position, the amount of light incident on the phototransistor is gradually reduced, and the current key position is determined on the basis of the amount of light received. Thus, the key sensors 27 produce key position signals representative of the current key positions continuously varied in the downward motion of the associated black and white keys 72/74.

The key sensors 27 are causative of another sort of individuality inherent in the automatic playing system. For example, if the transparent plate is stained, the amount of light passing therethrough is unintentionally reduced. When the shutter plate is offset from the target position on the lower surface of the associated key, when the sensor heads are offset from the target positions on the key bed 98, the light intensity is varied on the phototransistors. The aged deterioration is unavoidable in the light emitting diodes and phototransistors. The bias voltage is, by way of example, varied with time. The light emitting diodes and phototransistors are supplied with electric power from a suitable power source. The power source can not perfectly protect the power voltage from undesirable potential fluctuation. These are other factors of the other sort of individuality. Of course, those factors are not evenly weighted. Some factors may be ignoreable, and another factor is serious.

The key sensors 27 produce the key position signals in both of the playback and recording. While the controller 100 is being active for recording the performance, the black and white keys 72/74 are selectively depressed and released by a human player, and the unique key motion is converted to current key positions continuously varied. The analog key position signals are converted to digital key position signals also continuously varied in binary value by means of analog-to-digital converters.

On the other hand, while the controller 100 is being active for a playback, the key sensors 27 serve as the feedback sensors, and the controller 100 checks the key position signals to see whether or not the key actuators 10 give rise to target key motion. If the actual key motion is different from the target key motion, the driving signals are modified so as to make the actual key motion consistent with the target key motion.

The key position signals and hammer position signals reach the interface 37. The interface 37 appropriately reshapes the waveform of the hammer position signals and the key position signals, and, thereafter, converts the hammer position signals and key position signals to digital hammer position signals and digital key position signals by means of an analog-to-digital converter. Though not shown in FIG. 2, another interface 37 is further connected between the flexible disk driver 40 and the bus system 60, and music data codes are transferred through the interface to and from the flexible disk driver 40. A set of music data codes, which represents a performance on the keyboard 70, is written in a floppy disk 44 by means of the flexible disk driver 40 in the recording, and is read out from the floppy disk 44 through the flexible disk driver 40 in the playback. The controller 100 may further include a communication interface, to which music data codes are supplied from a remote data source through a public communication network.

The manipulating panel 42 is further connected to the interface 37. Plural button switches, a display window and indicators are provided on the manipulating panel 42. One of the button switches makes the controller 100 powered. Users give various instructions to the controller 100 through other button switches, and select a piece of music to be reproduced through another button switch. When a user wishes to record his or her performance, the user instructs the controller 100 to enter the recording mode through the manipulating panel 42. When the user wishes to reenact the performance, the user also instructs the controller to enter the playback mode through the manipulating panel 42. Thus, the manipulating panel 42 is a man-machine interface.

The pulse width modulator 30 serves as a driver for the key actuators 10 in the playback. The thrust of the plungers 15 is varied with the driving signals. In this instance, the pulse width modulator 30 changes the duty ratio of the driving signals for varying the thrust of the plungers 15. The pulse width modulator 30 may further change the magnitude of the driving signal. The pulse width modulator 30 includes plural modulation circuits so that the pulse width modulator 30 can concurrently supply the driving signals to plural key actuators 10. When the actual key motion is noticed to be late, the pulse width modulator 30 increases the duty ratio of the driving signals. On the other hand, if the black and white keys 72/74 are moved in advance, the pulse width modulator 30 decreases the duty ratio so that the plungers 15 are decelerated.

In this instance, the central processing unit 50, pulse width modulator 30, key actuators 10, key sensors 27 and interface 37 forms a feedback control loop 64, and the black and white keys 72/74 are inserted into the feedback control loop 64.

A main routine program, sub-routine programs and parameter tables are stored in the flash electrically erasable and programmable memory 54, and the random access memory 54 serves as a working memory for the central processing unit 50. The central processing unit 50 runs on the main routine program, and the main routine program selectively branches to the sub-routine programs. The behavior in the playback mode will be hereinafter described in detail.

Recording System and Behavior in Recording Mode

The recording system 5 includes the key sensors 27, hammer sensors 22, flexible disk driver 40, manipulating panel 42 and controller 100. Thus, the recording system 5 shares the system components 22, 27, 40, 42, 100 with the playback system 3.

When a user instructs the controller 100 to record his or her performance through the manipulating panel 42, the central processing unit 50 starts to run on the main routine program, and periodically enters the subroutine program for recording the performance. The central processing unit 50 starts an internal clock for measuring the lapse of time.

In the subroutine program, the central processing unit 50 fetches the pieces of music data representative of the current hammer positions and the pieces of music data representative of the current key positions, and accumulates those pieces of music data in the random access memory 54. Subsequently, the central processing unit 50 compares the current key positions with the previous key positions to see whether or not the user depresses or releases any one of the black and white keys 72/74.

If the central processing unit 50 notices the user depress one of the black and white keys 72/74, the central processing unit 50 acknowledges a key-on event, and specifies the depressed key 72/74. The shutter plate attached to the hammer 94 is assumed to intersect the light beam of the downstream photo coupler after the key-on event. The central processing unit 50 calculates the hammer velocity, and determines the lapse of time from the initiation of the performance or the previous event to the present note-on event. The central processing unit 50 produces a note-on event code and a duration code, and stores the pieces of music data representative of the key code assigned to the depressed key, hammer velocity and the lapse of time in the note-on event code and duration code. The note-on event code and duration code are different sorts of music data codes. The note-on event code is accompanied with the duration code.

If, on the other hand, the central processing unit 50 notices the user release the depressed key, the central processing unit 50 specifies the released key 72/74, and determines the timing at which the acoustic tone is to be decayed. The timing is approximately equal to the timing at which the damper 92 is brought into contact with the vibrating string 96. The central processing unit 50 determines the lapse of time from the previous event and the timing at which the acoustic tone is to be decayed. The central processing unit produces a note-off event code and the duration code, and stores the pieces of music data representative of the key code and the lapse of time in the note-off event code and associated duration code. The note-off event code is another sort of music data code, and is accompanied with the duration code. Term "event code" hereinafter stands for both of the note-on event code and note-off event code.

Though not shown in the drawings, the automatic player piano further includes damper, soft and sostenuto pedals and associated pedal sensors, and the central processing unit 50 also accumulates pieces of music data representative of the current pedal positions in the random access memory 54. When the central processing unit 50 acknowledges that the user steps on the pedal, the central processing unit produces a music data code representative of the effect.

While the user is fingering a piece of music on the keyboard 70, the central processing unit 50 periodically enters the subroutine program, and returns to the main routine program so that the music data codes are intermittently produced and accumulated in the random access memory 54. The pieces of music data are normalized, and some individualities are eliminated from the pieces of music data. Thus, the jobs of the recording system 5 are summarized as a series combination of a music data producer 130 and a post processor 140 as shown in FIG. 1.

Upon completion of the performance, the user may instruct the central processing unit 50 to transfer the set of music data codes representative of the performance. If so, the central processing unit 50 transfers the set of music data codes from the random access memory 54 to the flexible disc driver 40, and are stored in the floppy disc 44.

System Behavior in Playback Mode

Figure 3:
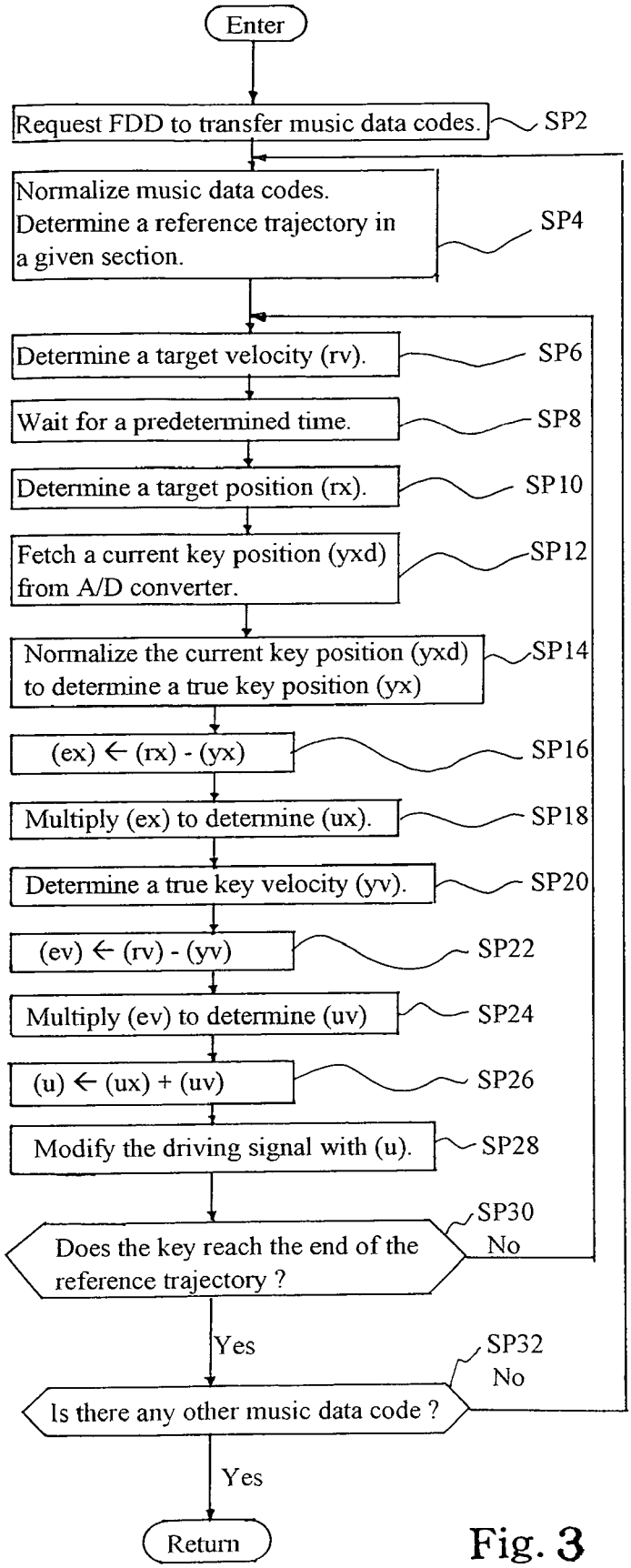
FIG. 3 is a flowchart showing a control sequence on black/white keys in a playback mode.

The automatic playing system 3 achieves jobs expressed as a series combination of a motion designer 110 and a motion controller 120 as shown in FIG. 1. FIG. 3 shows a control sequence on the black/white keys 72/74 in the playback mode. When a user instructs the controller 100 to reproduce a performance, the central processing unit 50 starts the control sequence for selectively move the black/white keys 72/74, and reproduces the performance on the keyboard 70. The control sequence is stored in the flash-type electrically erasable programmable read only memory 52 in the form of subroutine program. The central processing unit 50 periodically enters the subroutine program at a timer-interruption, and returns to the main routine program. This means that the central processing unit 50 periodically stops the execution, and restarts it upon the entry into the subroutine program. Nevertheless, the control sequence is hereinafter described as if the central processing unit 50 continuously achieves the tasks for the sake of simplicity.

Upon reception of the user's instruction to reproduce the performance, the central processing unit 50 requests the floppy disk driver 40 to transfer a set of music data codes representative of the performance to the random access memory 54. The floppy disk driver 40 reads out the set of music data codes from the floppy disk 44, and successively transfers the music data codes to the random access memory 54 as by step SP2. The address is synchronously incremented, and the music data codes are written in the random access memory 54.

Subsequently, the central processing unit 50 fetches the music data codes representative of the first note-on event. The central processing unit 50 normalizes the pieces of music data in the music data codes, and determines the reference trajectory for the black/white key 72/74 to be moved as by step SP4. When the central processing unit 50 determines the reference trajectory, the central processing unit differentiates the reference trajectory, and determines a target key velocity at the next monitoring time on the reference trajectory as by step SP6. The central processing unit 50 stands idle for a predetermined time as by step SP8.

When the predetermined time is expired, the central processing unit 50 determines a present target position rx at the monitoring time as by step SP10. The current key position is continuously reported from the associated key sensor 27 through the analog key position signal, and the analog key position signal is converted to the digital key position signal through an analog-to-digital converter incorporated in the interface 37. The central processing unit 50 fetches the piece of positional data representative of the current key position yxd from the analog-to-digital converter as by step SP12.

The central processing unit 50 normalizes the current key position yxd so as to obtain a true key position yx as by step SP14. The central processing unit 50 subtracts the true key position yx from the present target position rx, and determines a positional difference ex as by step SP16. The central processing unit 50 multiplies the positional difference ex by a predetermined gain kx so as to determine a controlling factor ux as by step SP16.

Subsequently, the central processing unit 50 fetches the true key position at the previous monitoring time, and calculates a true key velocity yv on the basis of the true key position yx at the present monitoring time and the true key position at the previous monitoring time as by step SP20. The central processing unit 50 subtracts the true key velocity yv from the target key velocity ry so as to determine a velocity difference ev as by step SP22. The central processing unit multiplies the velocity difference ev by a predetermined gain kv, and determines a controlling factor uv as by step SP24.

The central processing unit 50 adds the positional controlling factor ux to the velocity controlling factor uv so as to determine a controlling factor u as by step SP26. The central processing unit 50 sends the controlling factor u to the pulse width modulator 30, and requests the pulse width modulator 30 to optimize the pulse width of the driving signal as by step SP28. When the black/white key 72/74 is ahead of the target key position, the controlling factor u is indicative of the deceleration, and the pulse width modulator 30 decreases the duty ratio of the driving signal. The driving signal makes the magnetic field weaker than before, and the plunger 15 decelerates the black/white key 72/74. On the other hand, if the black/white key 72/74 have not reached the target key position, the controlling factor u is indicative of the acceleration, and the pulse width modulator 30 increases the duty ratio of the driving signal. The driving signal makes the magnetic field stronger than before, and the plunger 15 accelerates the associated black/white key 72/74.

Subsequently, the central processing unit 50 checks the target key position to see whether or not the black/white key 72/74 reaches the end of the reference trajectory as by step SP30. If the black/white key 72/74 is still on the way to the end of the reference trajectory, the answer at step SP30 is given negative, and the central processing unit 50 returns to step SP6. Thus, the central processing unit 50 reiterates the loop consisting of steps SP6 to SP30, and periodically checks the key motion at the monitoring points to see whether the black/white key 72/74 is to be accelerated or decelerated.

When the black/white key 72/74 reaches the end of the reference trajectory, the answer at step SP30 is given affirmative, and the central processing unit 50 checks the random access memory 54 to see whether or not all the note-events were reproduced as by step SP32. While the answer at step SP32 is being given negative, the central processing unit 50 reiterates the loop consisting of steps SP4 to SP32. When the answer at step SP32 is changed to affirmative, the central processing unit 50 returns to the main routine program, and the main routine program does not branch to the sub-routine program until the reception of the user's instruction to reproduce a performance.

The central processing unit 50 and instruction codes corresponding to steps SP4, SP6, SP8 and SP32 realize the motion designer 110, and the central processing unit 50 and instruction codes corresponding to steps SP10 to SP30 realize the motion controller 120.

Figure 4:
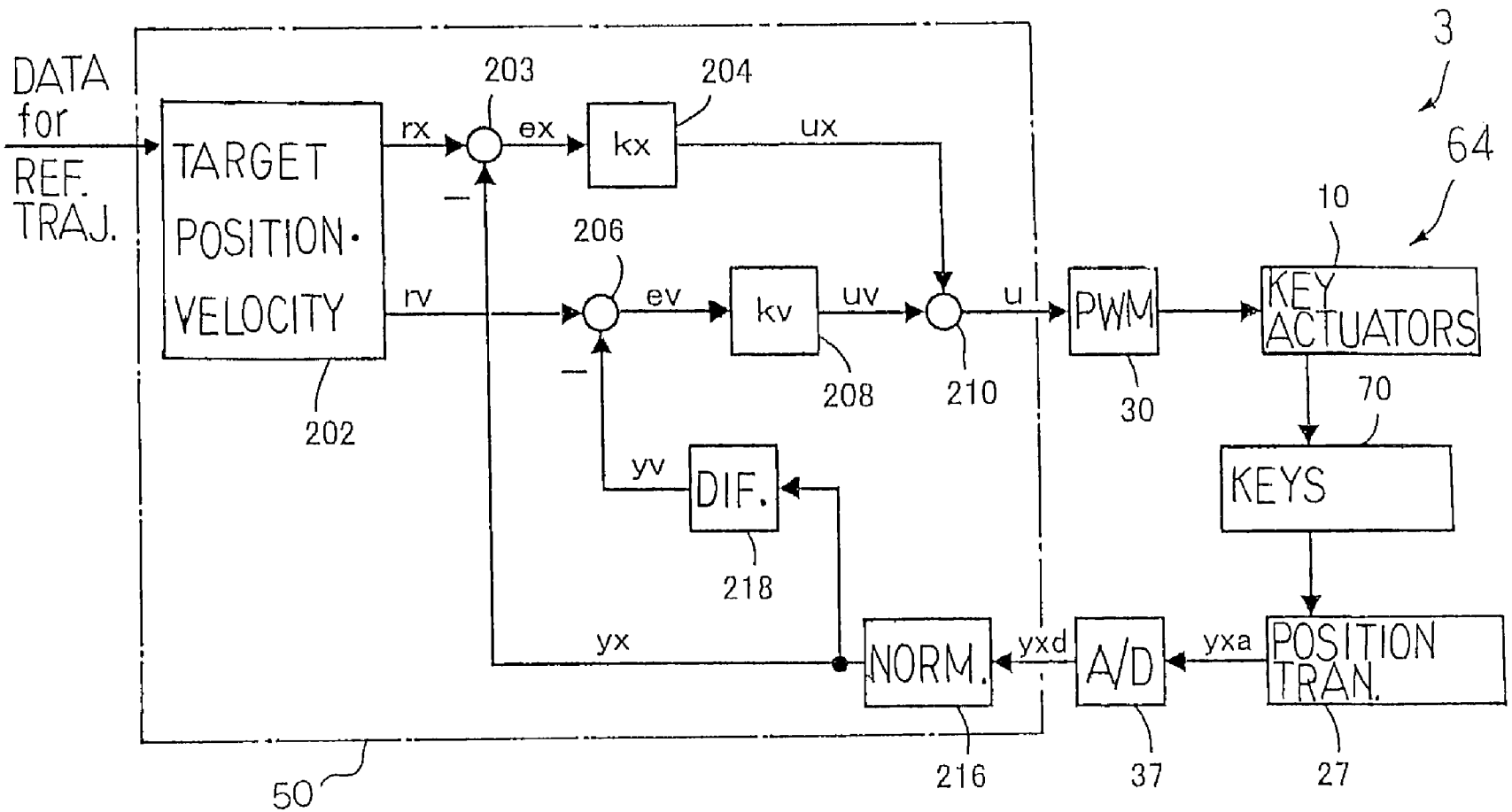
FIG. 4 is a block diagram showing an algorithm employed in a feedback loop incorporated in the automatic player piano.

Description hereinafter focused on the feedback loop 64. FIG. 4 shows the algorithm employed in the feedback control loop 64 incorporated in the automatic player piano. As described hereinbefore, the central processing unit 50, pulse width modulator 30, key actuators 10, keyboard 70, key sensors 27 and interface 37 form the feedback loop 64.

The key sensors 27, i.e., position transducers 27 convert the current key positions "yxa" to the analog key position signals, and the analog key position signals, which expresses the current key positions yxa, are supplied to the interface 37. Box 202 stands for the tasks before the central processing unit 50 at steps SP4, SP6 and SP10, and the central processing unit 50 determines the target key position rx and target key velocity rv on the basis of the reference trajectory. The reference trajectory is a series of values of the keystroke varied with time. When a time is given to the box 202, the box 202 outputs the target key position rx at the given time, and calculates the gradient of the reference trajectory at the given time, i.e., the target key velocity rv.

The central processing unit 50 further realizes the function expressed by circles 203/206/210 and boxes 204/208/216/218 through the execution of the sub-routine program. The true key velocity yv is calculated on the basis of the true key position yx, and the true key position yx and true key velocity yv are respectively compared with the target key position rx and target key velocity rv for determining an average current to be supplied to the key actuators 10 or an optimum duty ratio of the driving signal.

In detail, the circle 203 stands for the task before the central processing unit 50 at step SP16, and the central processing unit 50 determines the positional difference ex between the target key position rx and the true key position yx through the subtraction. Similarly, the circle 206 stands for the task before the central processing unit 50 at step SP22, and the central processing unit 50 determines the velocity difference ev between the target key velocity rv and the true key velocity yv through the subtraction. The boxes 204 and 208 stand for the tasks before the central processing unit 50 at steps SP18 and SP24, and the central processing unit 50 determines the positional controlling factor ux and velocity controlling factor uv through the multiplication by the gains kx and kv, respectively. The circle 210 stands for the task before the central processing unit 50 at step SP26, and the central processing unit 50 determines the controlling factor u through the addition.

The controlling factor u is representative of the average current to be supplied to the key actuator 10 or the optimum duty ratio of the driving signal, and is supplied to the pulse width modulator 30. The pulse width modulator 30 adjusts the driving signal to the optimum duty ratio u, and the thrust, which is exerted on the plunger 15, is varied.

Assuming now that the plunger 15 has already started to project, the position transducer 27 determines the current key position "yxa", and supplies the analog key position signal to the interface 37. The analog key position signal is converted to a digital key position signal representative of the binary code "yxd", the binary number of which is equivalent to the magnitude of the analog key position signal. The piece of positional data, i.e., binary code "yxd" is fetched by the central processing unit 50, and the piece of positional data representative of the current key position "yvd" is normalized to the true key position "yx" as by box 216. The normalization aims at elimination of individualities of the black/white keys 72/74 and individualities of the position transducers 27, and is expressed as $$yx=R*yxd+S[\text{mm}] \quad \text{Equation 1}$$

where R is a correction factor of the gain and S is a correction factor of the offset. The correction factors R and S are given through experiences. The values of correction factors R/S are tabled in the flash-type electrically erasable and programmable read only memory 52, and the central processing unit 50 accesses the table to fetch the proper values.

The central processing unit 50 fetches the piece of normalized positional data "yx" representative of the true key position, and calculates the target key velocity "yv" through the differentiation on the true key positions "yx" as follows.

$$yv=(yx0-yx1)/T[\text{mm/sec.}] \quad \text{Equation 2}$$

where yx0 is the current true key position and yx1 is the previous true key position.

The central processing unit 50 subtracts the true key position "yx" and true key velocity "yv" from the target key position "rx" and target key velocity "ry", which have been already calculated by the box 202.

Although how the reference trajectory is determined is described in detail in Japanese Patent Application laid-open No. 7-175472, description is simply made on the reference trajectory on the assumption that the black/white keys 72/74 take uniform motion. The reference trajectory is a set of values of the target key position. The target key position "rx" is expressed as follows.

$$rx=f(vm)*t+rx0 \quad \text{Equation 3}$$

where f stands for a function, vm is the velocity defined in MIDI protocols, t is a time and rx0 is initial value. The target key velocity "rv" is given as Equation 4.

$$rv=d(rx)/dt=f(vm) \quad \text{Equation 4}$$

f(vm) is an exponential function. The target key position rx and target key velocity rv are calculated by the central processing unit 50, or are prepared as tables.

The differences "ex" and "ev" are respectively multiplied by the gains "kx" and "kv" at boxes 204 and 208. The positional controlling factor ux and velocity controlling factor uv are supplied to the adder 210, and are added to each other. The sum or the controlling factor "u" is indicative of the optimum duty ratio, to which the pulse width modulator 30 is to adjust the driving signal. The sum "u" is supplied to the pulse width modulator 30, and the pulse with modulator 30 adjusts the driving signal to the optimum duty ratio.

The strength of the magnetic field is varied depending upon the mean driving current, and the thrust, which is exerted on the plunger 15, is also varied. The plunger 15 is decelerated, accelerated or maintained through the feedback control loop 64. Thus, the feedback control loop 64 gives rise to the original key motion of the other black/white keys 72/74.

As will be understood, the plunger motion and, accordingly, key motion are controlled through the feedback control loop 64, and both key position and key velocity are taken into account in the feedback control. The gain kx for the positional difference ex and gain kv for the velocity difference ev are given to the feedback control loop 64 independently of each other. This feature is desirable, because the response characteristics of the feedback control loop 64 are easily optimized.

Figure 5:
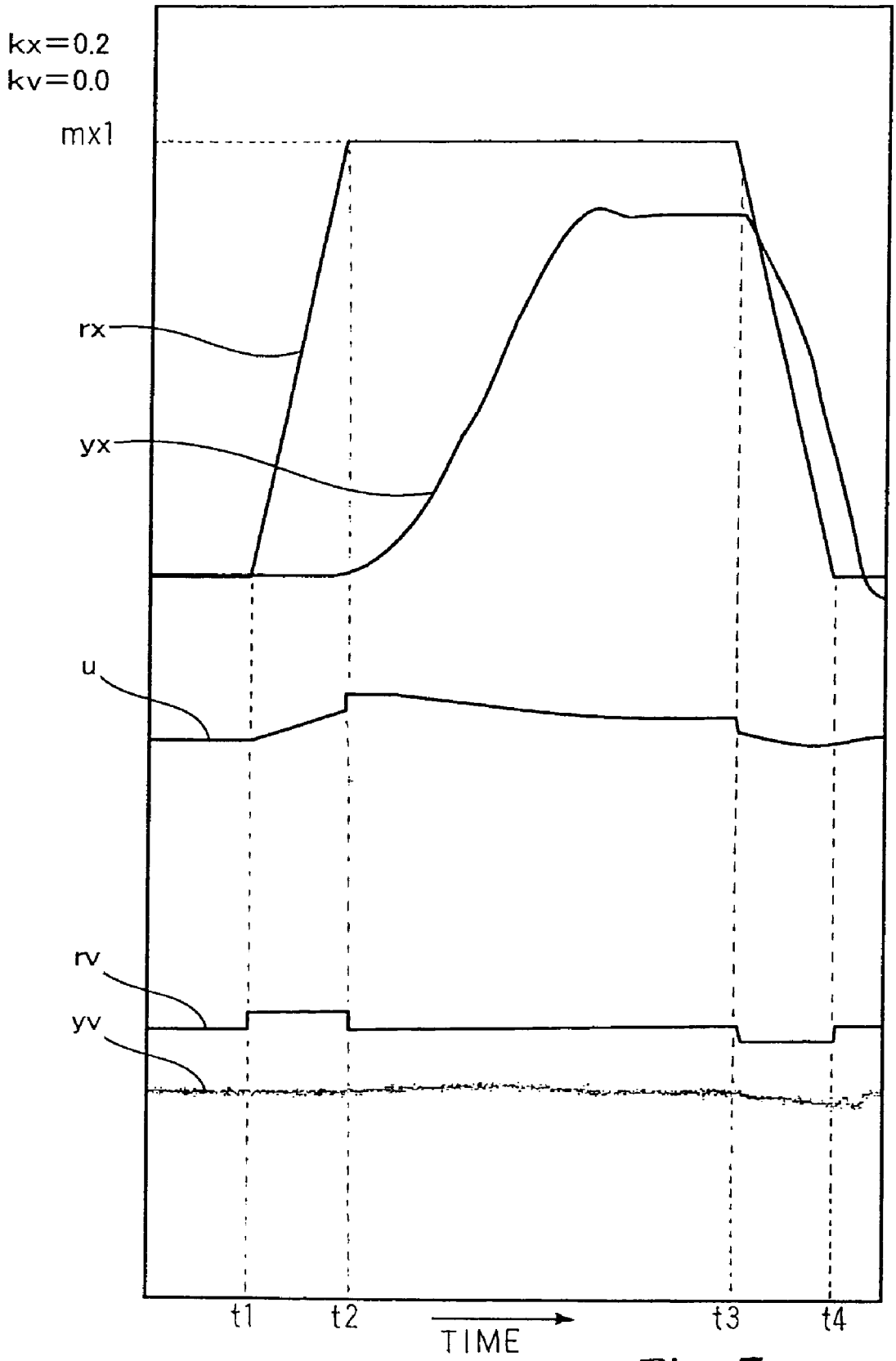
FIG. 5 is a diagram showing the response characteristics of a feedback control loop observed in an experiment.

The present inventor investigated influences of the gains kx/kv on the response characteristics of the feedback control loop 64. FIG. 5 shows the response characteristics of the feedback control loop 64 on the condition that both gains kx and kv were small. The gains kx and kv were adjusted to 0.2 and 0.0, respectively. The target key velocity "rv" was sharply increased at time t1, and was recovered at time t2. The target key velocity "rv" was sharply reduced at time t3 and was recovered at time t4. Although the adder 210 varied the controlling factor "u", the true key velocity "yv" was almost constant due to the small gains kx and kv, and the true key position "yx" did not follow the target key position "rx". Since the black/white key 72/74 did not reach the maximum stroke mx1, the associated string 4 was not struck with the hammer 2, and any acoustic tone was not heard from the automatic player piano.

Figure 6:
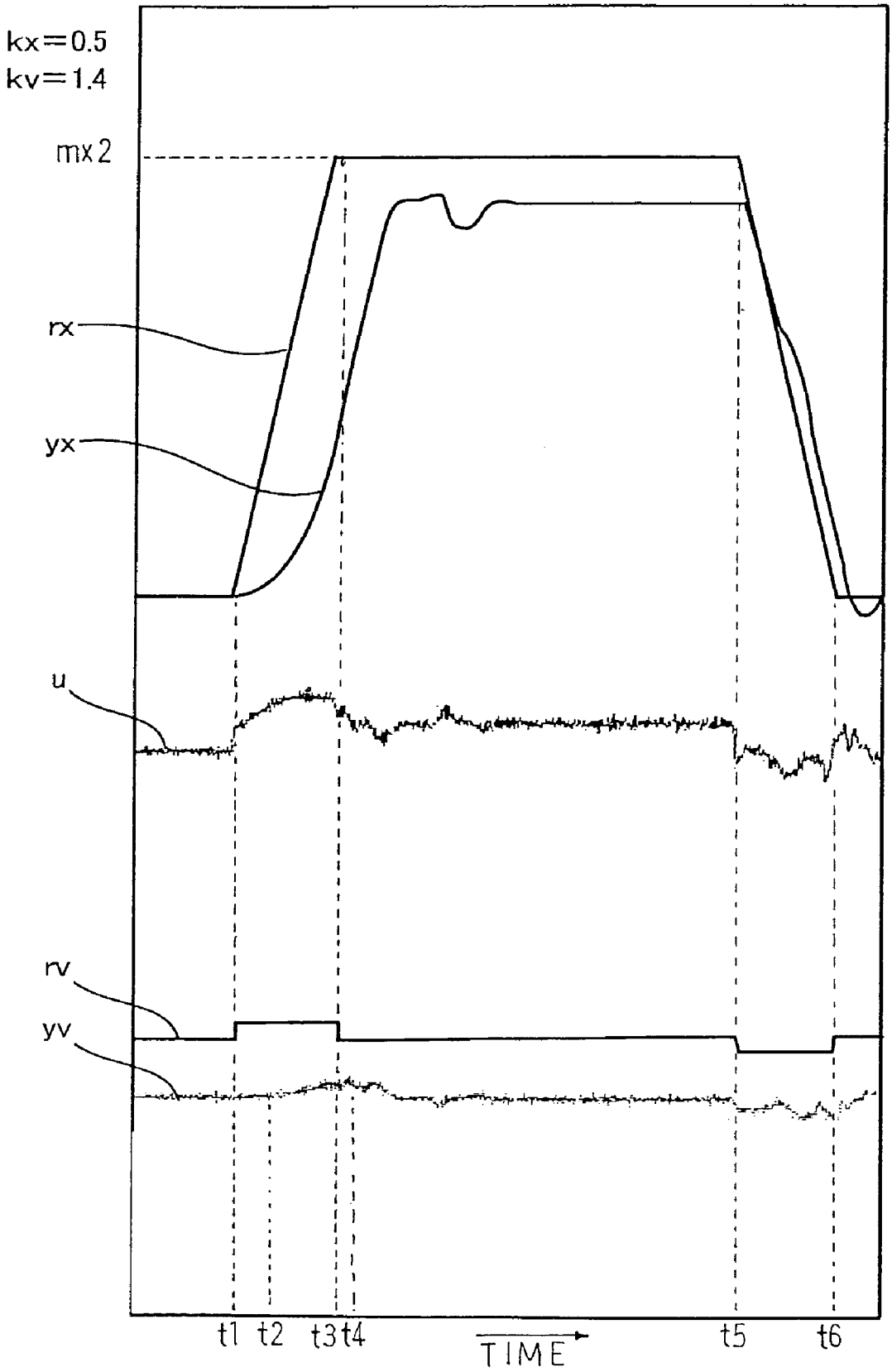
FIG. 6 is a diagram showing the response characteristics of the feedback control loop on another condition.

FIG. 6 shows the response characteristics of the feedback control loop 64 on another condition. The gains kx and kv were adjusted to 0.5 and 1.4, respectively. The target key velocity was kept high between time t1 and time t3, and was low between time t5 and time t6. The true key velocity "yv" started to rise at time t2, and reached the peak around t4. Although the true key position "yx" responded earlier than that shown in FIG. 5, the true key position "yx" did not reach the maximum stroke mx2, and the automatic player piano faintly generated the acoustic tone. Thus, the acoustic tone, which was generated in the playback, was smaller in loudness than the original acoustic tone was.

Figure 7:
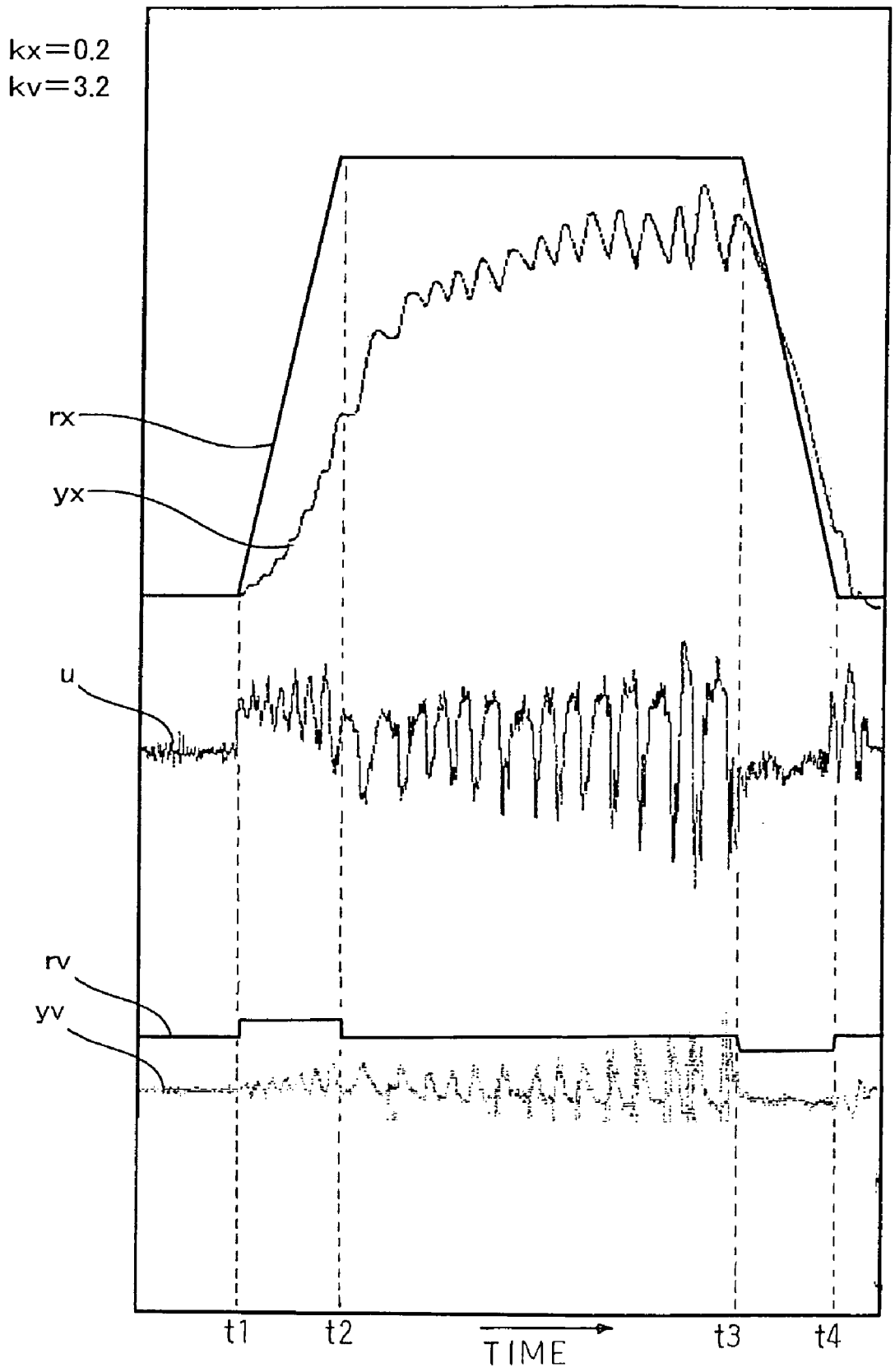
FIG. 7 is a diagram showing the response characteristics of the feedback control loop on yet another condition.

FIG. 7 shows the response characteristics of the feedback control loop 64 on yet another condition. The gains kx and kv were adjusted to 0.2 and 3.2, respectively. The target key velocity was also kept high between time t1 and time t3, and was low between time t3 and time t4. Since the gain kv was much larger than the gain kx, both of the true key velocity "yv" and true key position "yx" oscillated, and the controlling factor "u" was widely swung. Thus, the feedback control loop 64 made the automatic player piano unstable in the playback.

Figure 8:
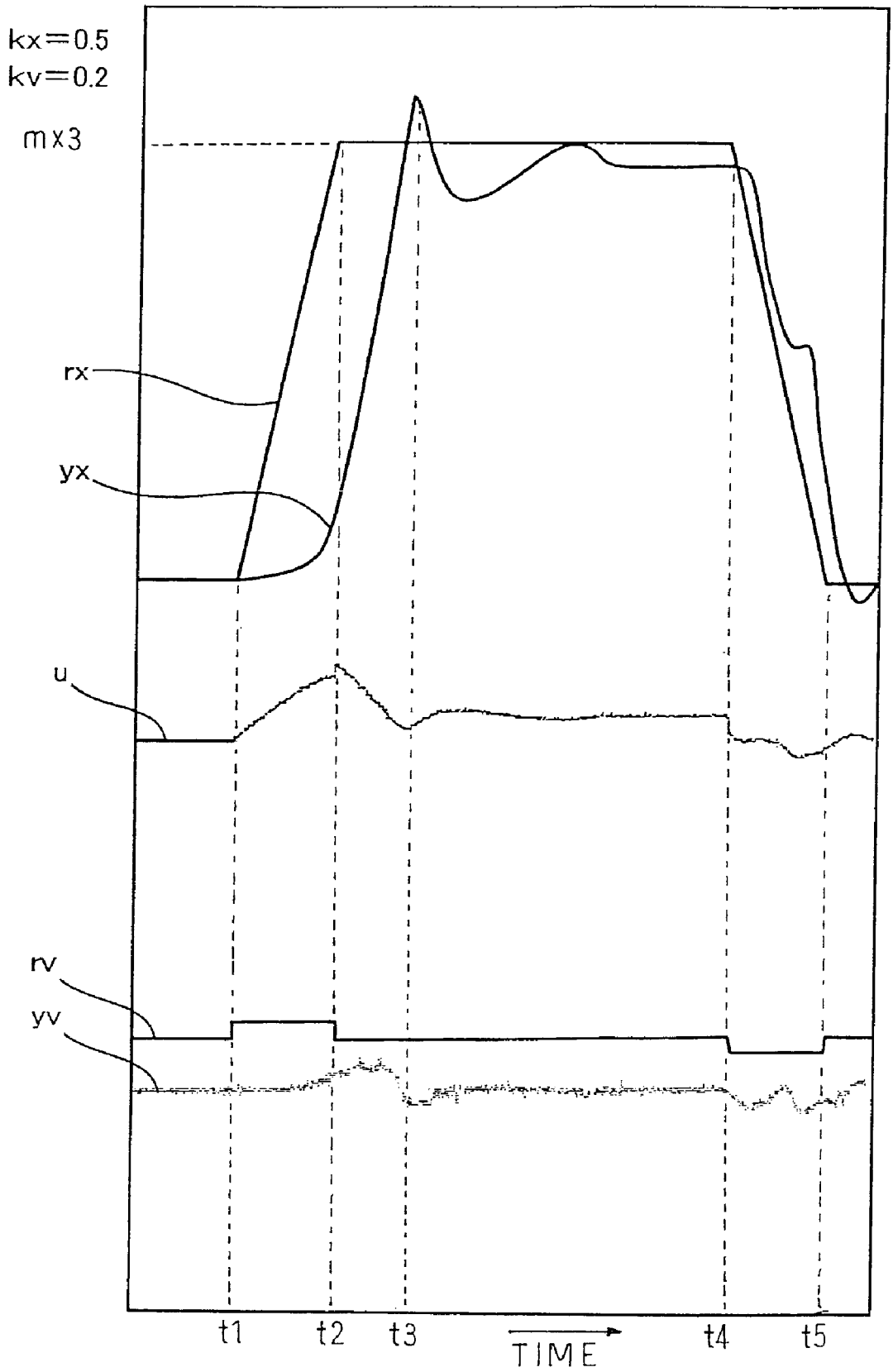
FIG. 8 is a diagram showing the response characteristics of the feedback control loop on still another condition.

FIG. 8 shows the response characteristics of the feedback control loop 64 on still another condition. The gains kx and kv were adjusted to 0.5 and 0.2, respectively. The target key velocity was also kept high between time t1 and time t2, and was low between time t4 and time t5. The correction with the velocity controlling factor "uv" was so poor that the true key position "yx" exceeded the maximum keystroke mx3. Since the true key position "yx" reached the peak at time t3 the associated string 4 was violently struck with the hammer 2, and the acoustic piano tone produced in the playback was larger in loudness than the original tone.

Figure 9:
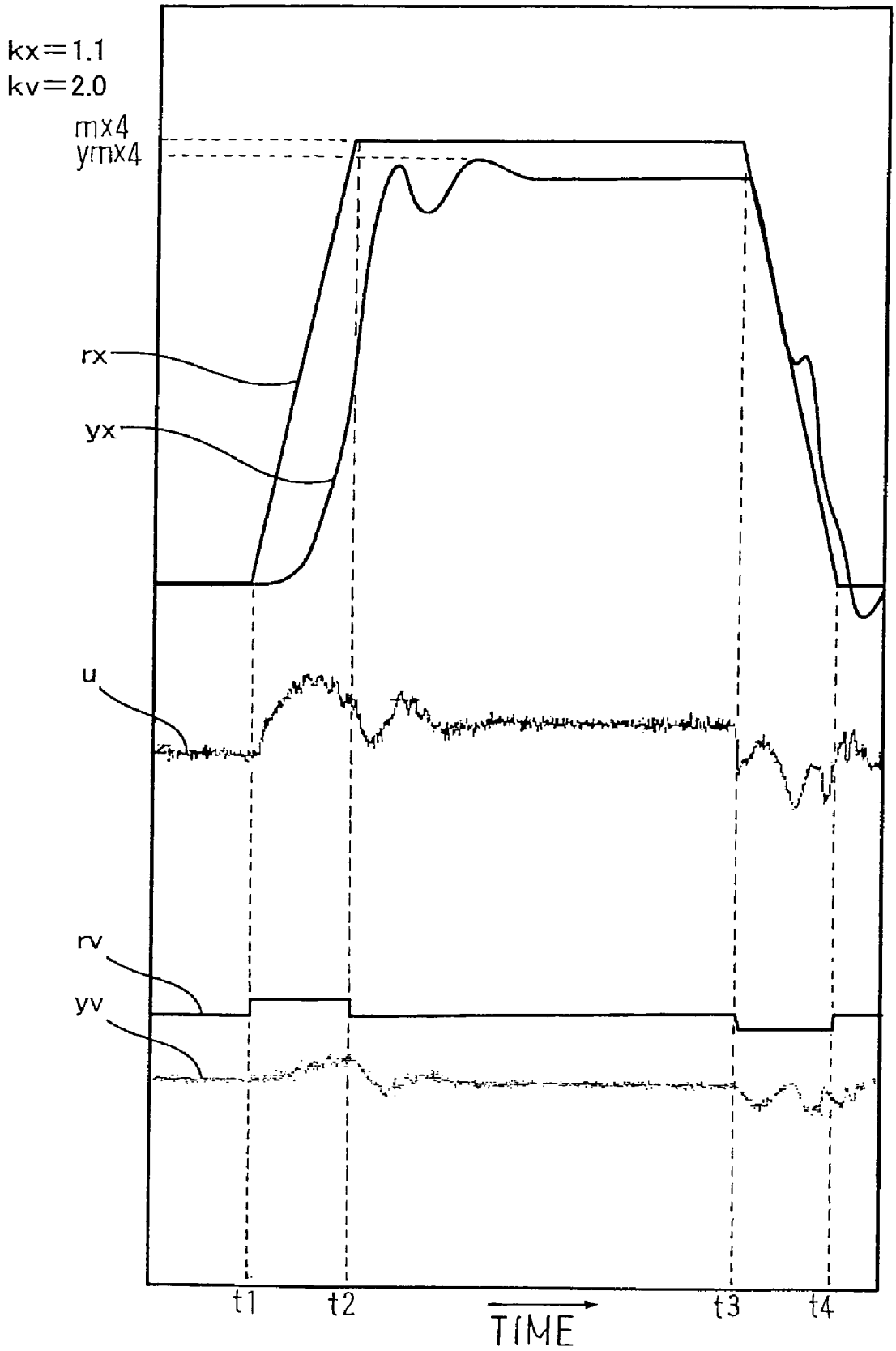
FIG. 9 is a diagram showing the response characteristics of the feedback control loop on yet another condition.

FIG. 9 shows the response characteristics of the feedback control loop 64 on yet another condition. The gains kx and kv were adjusted to 1.1 and 2.0, respectively. The target key velocity was also kept high between time t1 and time t2, and was low between time t3 and time t4. The gains kx and kv were optimized, and were well balanced with each other. The true key velocity "yv" was varied together with the target key velocity "rv", and the true key position "yx" well followed the target key position "rx". As a result, he true key position "ymx4" closely reached the maximum keystroke mx4. This resulted in the acoustic tone as large in loudness as the original tone.

The present inventor repeatedly carried out the experiments on different conditions, and obtained a table shown in FIG. 10. The column is indicative of the gain kx, and the gain kx was changed from 0.0 to 2.3. On the other hand, the row is indicative of the gain kv, and the gain kv was changed from 0.0 to 3.5. The present inventor adjusted the gains kx and kv to the values in the table, and instructed the automatic player piano to reproduce the original tone. The result was indicated at the crossing points between the row and the column. Mark "*" means that any tone was not generated, mark "+" means that the tone was larger in loudness than the original tone was, mark "ok" means that the tone was almost as large in loudness as the original tone was, mark "–" means that the tone was smaller in loudness than the original tone was, and mark "#" means that the key motion was unstable due to the oscillation, by way of example.

From the table, it is understood that the minimum gains kx and kv are equal to 0.5. On the other hand, the maximum gains kx and kv are equal to 2.0 and 2.3, respectively. When the ratio of gain kv to the gain kx is fallen within 1 to 3, the feedback control loop 64 tended to get the good mark "ok". Thus, the present inventor found the numerical range for reproducing the tones at the target loudness.

Second Embodiment

Figure 11:
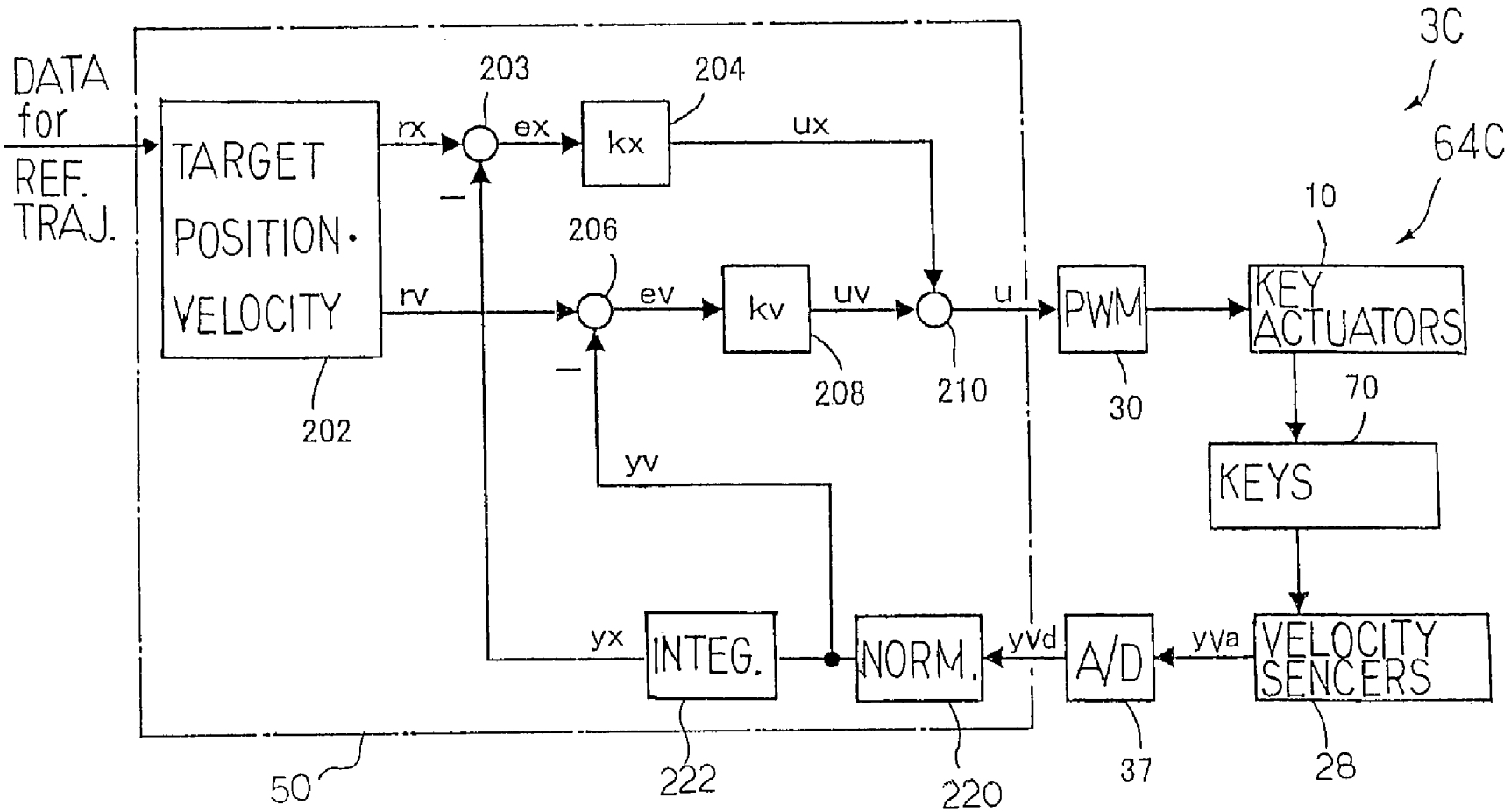
FIG. 11 is a block diagram showing an algorithm employed in a feedback loop incorporated in another automatic player piano.

FIG. 11 shows another algorithm employed in a feedback control loop 64C incorporated in another automatic player keyboard musical instrument embodying the present invention. The automatic player keyboard musical instrument also comprises an acoustic piano, a recording system and an automatic playing system 3C. The acoustic piano and recording system are similar to the acoustic piano and recording system of the automatic player keyboard musical instrument implementing the first embodiment, and the velocity sensors 28 are used in the recording system and automatic playing system 3C. However, the subroutine program in the playback mode and feedback control loop 64C are different from those of the automatic playing system 3. For this reason, description is hereinafter focused on the feedback control loop 64C. The system components of the automatic playing system 3C are hereinafter labeled with the references designating the corresponding system components of the automatic playing system 3 without detailed description.

The central processing unit 50, pulse width modulator 30, key actuators 10, keyboard 70, velocity sensors 28 and interface 37 form the feedback loop 64C. The velocity sensors 28 convert the current key velocity "yva" to the analog key velocity signals, and the analog key velocity signals are supplied to the interface 37. The central processing unit 50 realizes the function expressed by boxes 202, 204, 208, 220 and 222 and circles 203, 206 and 210 through the execution on the subroutine program. In this instance, the true key position "yx" is calculated on the basis of the true key velocity "yv", and the true key position "yx" and true key velocity "yv" are respectively compared with the target key position "rx" and target key velocity "rv" for determining a target duty ratio. The functions at the circles 203/206 and boxes 204/208 are same as those of the first embodiment, and functions of boxes 220 and 222 are different from those of the boxes 216 and 218. The following normalization is carried out at the box 220.

$$yv=P*yvd+Q[\text{mm/sec}] \qquad \text{Equation 5}$$

where P is a correction factor of the gain and Q is a correction factor of the offset. The correction factors P and Q are determined through experiments, and are stored in the flash-type electrically erasable and programmable read only memory 52. On the other hand, the true key velocity yv is integrated at the box 222, and the true key position yx is determined through the integration.

Assuming now that the plunger 15 has already started to project, the velocity sensor 28 determines the current key velocity "yva", and supplies the analog key velocity signal to the interface 37. The analog key velocity signal is converted to a digital key velocity signal representative of the binary code "yvd", the binary number of which is equivalent to the magnitude of the analog key velocity signal. The piece of velocity data, i.e., binary code "yvd" is fetched by the central processing unit 50, and the piece of positional data "yvd" is normalized to a true key velocity "yv" at the box 220. However, when the designer determines the calibration factor, he or she takes the amplifications at boxes 204 and 208 into account.

The central processing unit 50 fetches the piece of normalized velocity data "yv" representative of the true key velocity, and calculates a true key position "yx" through the integration on the true key velocity "yv" as follows.

$$yx=yx1+yv0*T[\text{mm}] \qquad \text{Equation 6}$$

where yx1 is the previous true key position, yv0 is the current true key velocity, T is the lapse of time from yx1 and * is the multiplication sign. The lapse of time may be equal to the sampling time interval.

The central processing unit 50 subtracts the true key position "yx" and true key velocity "yv" from the target key position "rx" and target key velocity "ry", which have been already calculated, at the circles 203 and 206.

The differences "ex" and "ev" are respectively multiplied by the gains "kx" and "kv" at the boxes 204 and 208. The products, i.e., the positional controlling factor "ux" and the velocity controlling factor "uv" are indicative of the mean driving current, that is, target values of the duty ratio from the different viewpoints. The piece of control data representative of the target values of the duty ratio "ux" and "uv" are supplied to the adder 210, and are added to each other. The sum, i.e., the controlling factor "u" is indicative of a target value of the duty ratio, to which the duty ratio of the driving signal is to be adjusted. The sum "u" is supplied to the pulse width modulator 30, and the pulse with modulator 30 adjusts the driving signal to the target duty ratio.

The strength of the magnetic field is varied depending upon the target duty ratio, and the thrust, which is exerted on the plunger 15, is also varied. This results in that the plunger 15 is decelerated, accelerated or maintained in velocity.

Although the force, which is exerted on the associated black and white key 72/74, is varied, the key motion does not immediately follow. A time lag occurs between the change of the thrust and the change of the key motion, and is dependent on the individualities of the keyboard 70 and the individualities of the associated velocity sensor 28. For this reason, even though the velocity sensor 28 exactly converts the current key velocity "yva" to the analog key position signal, the change of the current plunger position is not exactly transferred to the current key velocity "yva". The analog key velocity signal is converted to the digital key velocity signal, and the current key velocity "yva" is expressed by the binary code "yvd".

The central processing unit 50 fetches the piece of positional data or the binary value "yvd" from the interface 37, and normalizes the current key velocity at the box 220. The true key position "yx" is calculated through the integration.

Thus, the central processing unit 50 prepares the true key position "yx" and true key velocity "yv".

The central processing unit 50 reads out the pieces of control data, and calculates the next target position "rx" and next velocity "rv" at the box 202. The differences "ex" and "ev" are calculated, and the target duty ratio is finally determined as described hereinbefore. Thus, the central processing unit 50 periodically checks the true key velocity "yv" and true key position "yx" to see whether or not the duty ratio, i.e., the thrust exerted on the plunger 15 is proper to force the plunger 15 to move on the reference trajectory through the above-described feedback control loop 64C. For this reason, the pulse width modulator 30 can always adjust the driving signal to the optimum duty ratio.

The present inventor confirmed that the above-described numerical ranges of the gains kx and kv were valid for the feedback control loop 64C.

Third Embodiment

Figure 12:
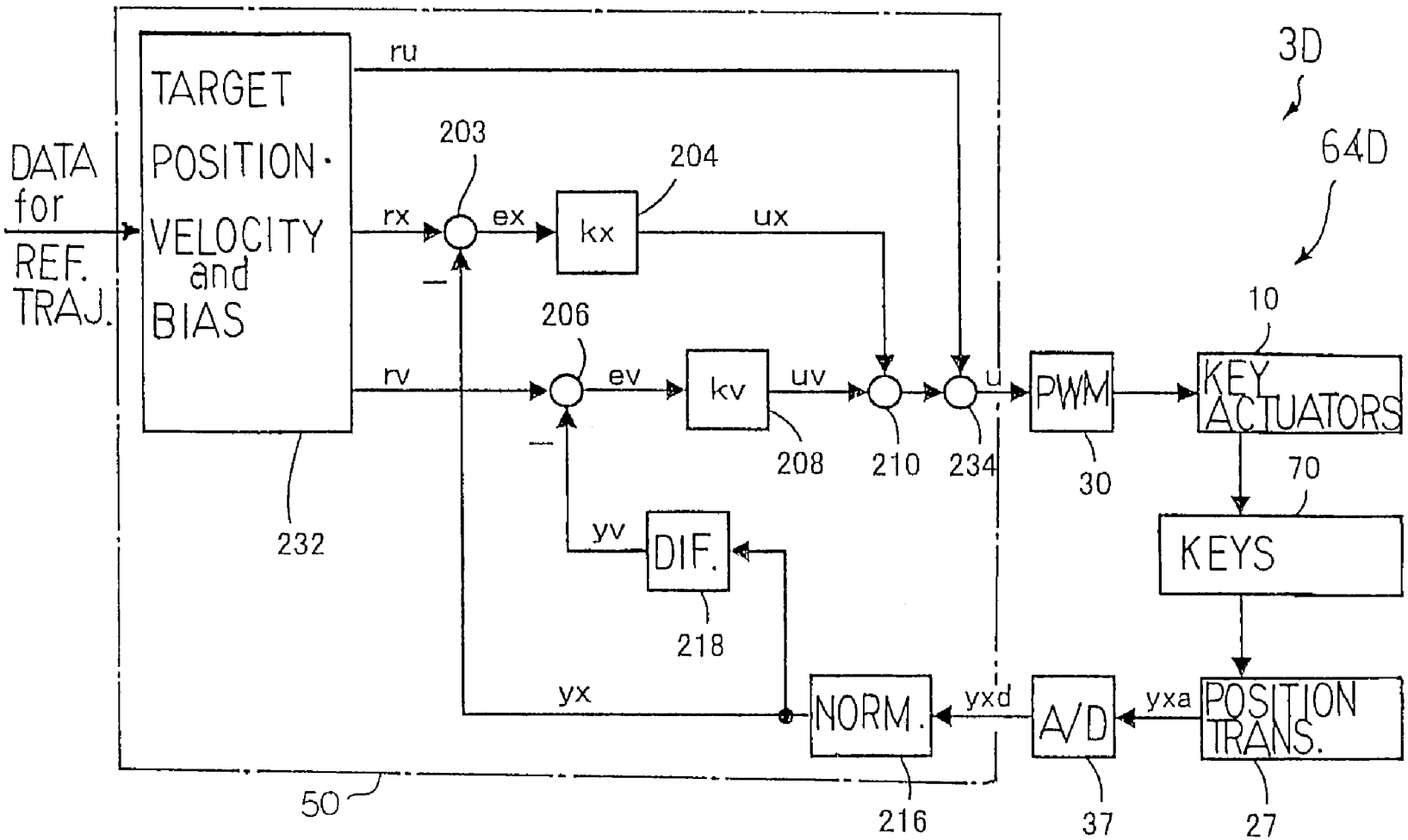
FIG. 12 is a block diagram showing an algorithm employed in a feedback loop incorporated in yet another automatic player piano.

FIG. 12 shows the algorithm employed in a feedback control loop 64D incorporated in yet another automatic player keyboard musical instrument embodying the present invention. The automatic player keyboard musical instrument also comprises an acoustic piano, a recording system and an automatic playing system 3D. The acoustic piano and recording system are similar to the acoustic piano 1 and recording system 5, and the position transducers 27 are used in the recording system and automatic playing system 3D. However, the subroutine program in the playback mode and feedback loop 64D are different from those of the automatic playing system 3. For this reason, description is hereinafter focused on the feedback loop 64D. The system components of the automatic playing system 3D are hereinafter labeled with the references designating the corresponding system components of the automatic playing system 3 without detailed description.

The central processing unit 50, pulse width modulator 30, key actuators 10, keyboard 70, key sensors or position transducers 27 and interface 37 form the feedback loop 64D. The position transducers 27 convert the current key position "yxa" to the analog key position signals, and the analog key position signals are supplied to the interface 37. The analog key position signals are converted to digital key position signals through the interface 37.

The central processing unit 50 realizes the function expressed by boxes 232, 203, 204, 206, 208, 210, 216, 218 and 234 through the execution on the subroutine program. Compare FIG. 12 with FIG. 4, we find the differences between the third embodiment and the first embodiment are to be directed to box 232 and circle 234. Not only target key position "rx" and target key velocity "rv" but also bias "ru" are output from box 232. The target key position "rx" and target key velocity "rv" are same as those shown in FIG. 4. The bias "ru" is indicative of a bias voltage to be supplied to the key actuators 10. The reason why the bias voltage is required for the key actuators 10 is prompt response to the driving signal. The driving signal is assumed to rise from zero. The plunger 15 does not immediately project from the combined structure of solenoid and yoke 17, because various sorts of resistance such as the weight of the key 72/74 and the elastic force of a return spring are exerted on the plungers 15 against the magnetic force. When the magnetic force exceeds the total resistance, the plunger 15 starts to project. The bias voltage "ru" causes the combined structure of solenoid and yoke 17 to exert the critical magnetic force, which is equivalent to the total resistance, on the plunger 15. The pulse width modulator 30 always applies the bias voltage to the combined structures of solenoids and yoke 17. When the pulse width modulator 30 raises the driving signal, the plunger 15 immediately projects from the combined structure of solenoid and yoke 17. Thus, the key actuators 10 are improved in promptness by virtue of the bias "ru".

In this instance, a constant bias "ru" is output from the box 232, and the bias "ru" is added to the sum of the "ux" and "uv" at the circle 234. The functions at the other boxes and circles are same as those shown in FIG. 4. For this reason, no further description on the feedback loop 64D is hereinafter incorporated for avoiding repetition. The above-described numerical range is substantially optimum to the third embodiment.

As will be appreciated from the foregoing description, the positional difference ex and velocity difference ev are multiplied by the gains kx and kv, respectively, and the gains kx and kv are independently adjusted to proper values. As a result, the controlling factor "u" is optimized in such a manner that the black/white keys 72/74 travels on the reference trajectories. This results in the faithful reenactment of the original performance through the automatic keyboard musical instrument.

Fourth Embodiment

Figure 13:
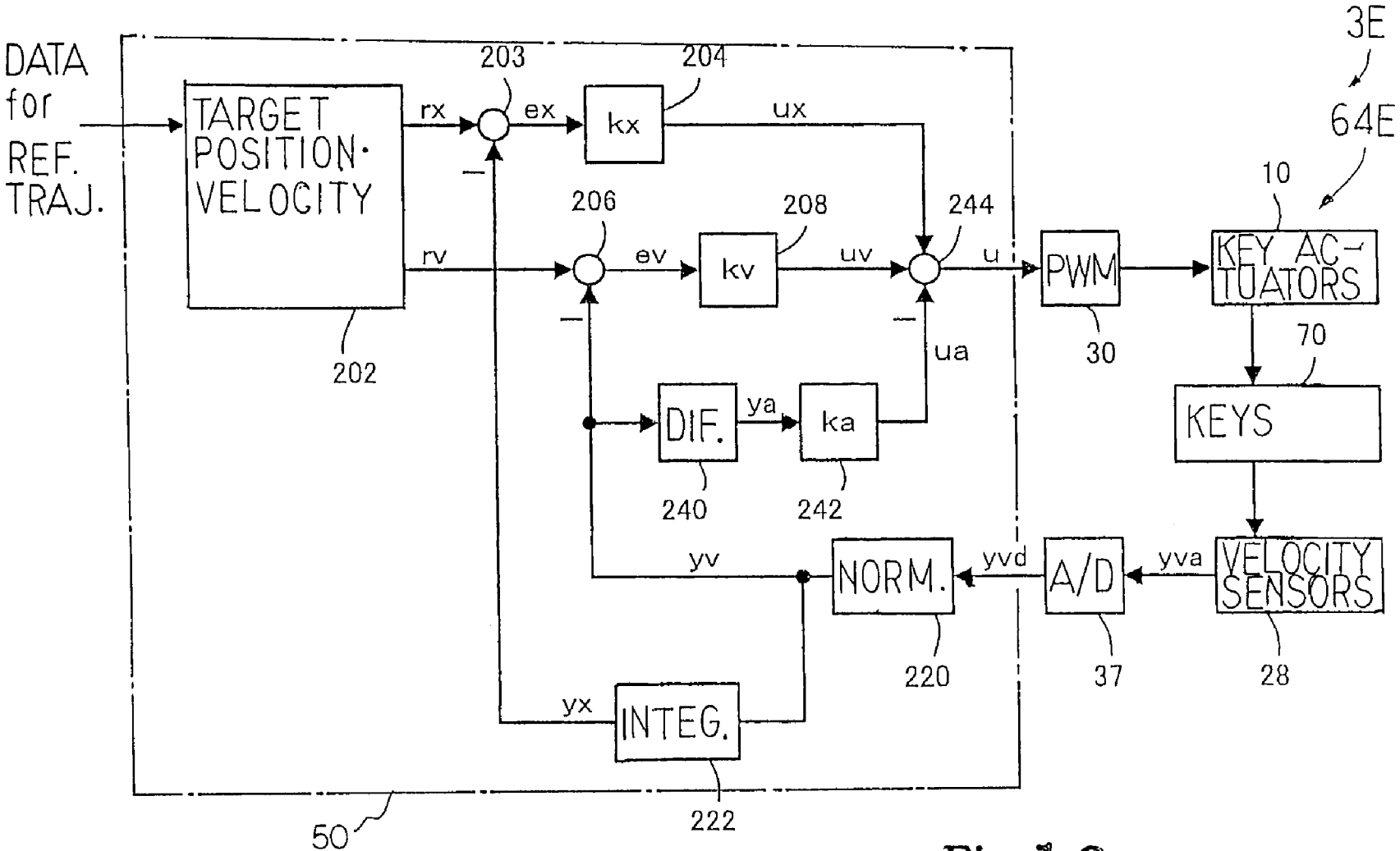
FIG. 13 is a block diagram showing an algorithm employed in a feedback loop incorporated in still another automatic player piano.

FIG. 13 shows the algorithm employed in a feedback control loop 64E incorporated in still another automatic player keyboard musical instrument embodying the present invention. The automatic player keyboard musical instrument also comprises an acoustic piano, a recording system and an automatic playing system 3E. The acoustic piano and recording system are similar to the acoustic piano and recording system of the second embodiment, and the velocity sensors 28 are used in the recording system and automatic playing system 3E. However, the subroutine program in the playback mode and feedback loop 64E are different from those of the automatic playing system of the second embodiment. For this reason, description is hereinafter focused on the feedback loop 64E. The system components of the automatic playing system 3E are hereinafter labeled with the references designating the corresponding system components of the automatic playing system 3 without detailed description.

The central processing unit 50, pulse width modulator 30, key actuators 10, keyboard 70, velocity sensors 28 and interface 37 form the feedback loop 64E. The velocity sensors 28 convert the current key velocity "yva" to the analog key velocity signals, and the analog key velocity signals are supplied to the interface 37. The analog key velocity signals are converted to digital key velocity signals through the interface 37.

The central processing unit 50 realizes the function expressed by boxes 202, 204, 208, 220, 222, 240, 242 and circles 203, 206 and 244 through the execution on the subroutine program. Comparing FIG. 13 with FIG. 11, we find differences between the fourth embodiment and the second embodiment are to be directed to boxes 240 and 242 and circle 244.

A true acceleration "ya" is calculated on the basis of the true key velocity through a differentiation at the box 240, and is amplified with gain "ka" at the box 242. The product or a controlling factor "ua" is indicative of the acceleration, and is supplied to the adder 244. The adder 244 adds the positional controlling factor "ux" to the velocity controlling factor "uv", and subtracts the controlling factor "ua" from the sum, i.e., u=ux+uv−ua. Thus, the controlling factors "ux"+"uv" is modified with the acceleration "ua". The controlling factor "u" is supplied to the pulse width modulator 30, and the pulse width modulator 30 adjusts the driving signal to the target duty ratio. When the designer determines the calibration factor for the gain, he or she takes the amplifications at the boxes 204, 208 and 242 into account. The other functions are same as those of the fourth embodiment, and no further description is omitted for the sake of simplicity.

The modification with the acceleration "ua" is preferable to the adjustment of the driving signal with the position and velocity. In detail, when the acceleration is large, the large acceleration makes the sum "ux+uv" reduced so as to prevent the plunger 15 and, accordingly, key 72/74 from the overshoot.

As will be appreciated from the foregoing description, the positional difference ex, velocity difference ev and acceleration are multiplied by the gains kx, kv and ka, respectively, and the gains kx, kv and ka are independently adjusted to proper values. As a result, the controlling factor "u" is optimized in such a manner that the black/white keys 72/74 exactly travels on the reference trajectories. This results in the faithful reenactment of the original performance through the automatic keyboard musical instrument.

Moreover, the acceleration is taken into account in this instance. This feature is desirable. Even if the acceleration is rapidly enlarged, the con-trolling factor "u" is gently increased, and the black/whit from the overshoot.

Although particular embodiments of the present invention have been shown and described, it will be apparent to those skilled in the art that various changes and modifications may be made without departing from the spirit and scope of the present invention.

For example, another automatic player piano may be fabricated on the basis of an upright piano. The acoustic piano does not set any limit to the technical scope of the present invention. An automatic player may be installed in another sort of musical instruments such as, for example, a harpsichord, an organ, stringed instruments, percussion instruments and wind instruments.

A mute system may be further incorporated in the automatic player piano according to the present invention, and the automatic player piano equipped with the silent system is referred to as a mute piano. The mute piano is a combination of the acoustic piano, automatic playing system, a hammer stopper and an electronic tone generating system. The hammer stopper is changed between a free position and a blocking position. While the hammer stopper is staying in the free position, the strings are struck with the hammers at the end of the free rotation, and the acoustic piano tones are generated through the vibrations of the strings. When the hammer stopper is changed to the blocking position, the hammer stopper enters the trajectories of the hammers. Although the hammers are driven for the free rotation, the hammers rebound on the hammer stopper before the end of the free rotation, and any acoustic piano tone is not produced. The electronic tone generating system monitors the keys selectively depressed and released by the player, and electronically produces tones at pitches equal to the pitches assigned to the depressed keys.

The computer program may be supplied from the outside of the automatic player musical instrument such as, for example, a flexible disk or a provider through a public communication network such as, for example, the internet.

The position, velocity and acceleration do not set any limit to the technical scope of the present invention. An array of pressure sensors may be provided under the black/white keys 72/74 so as to supply detecting signals representative of the force exerted thereon to the controller.

The key sensors 27 and key velocity sensors 28 do not set any limit to the technical scope of the present invention. Plunger sensors may monitor the plungers 15. In this instance, plunger position or plunger velocity is reported from the plunger sensors to the controller.

The box 202 may further calculate a target acceleration on the reference trajectory. In this instance, an adder is inserted between the box 240 and the box 242, and calculates a difference between the true acceleration ya and the target acceleration.

The gains may be variable. In this instance, the optimum gains are supplied from a gain controller to the boxes 204/208.

The pulse width modulator 30 does not set any limit to the technical scope of the present invention. The driving signals may be varied in potential level through a suitable resister array.

The solenoid-operated key actuators 10 do not set any limit to the technical scope of the present invention. Pneumatic actuators or miniature motors may be used in the automatic playing system 3.

The sensors 27 or 28 may monitor another sort of component parts such as, for example, hammers 2. Similarly, the solenoid-operated actuators 10 may drive another sort of component parts such as, for example, the action units 90.

The component parts of the embodiments are correlated with claim languages as follows. The strings 4 as a whole constitute a "tone generating subsystem", and the hammer 2, damper 4, black/white key 72/74 and action unit 90 form in combination each "motion propagating path". The box 202/232 serves as a "target state indicator". The position transducers 27 or velocity sensors 28 serve as plural "sensors". The black/white keys 72/74 are corresponding to "predetermined component parts" of the plural motion propagating paths.

The current key position or current key velocity is corresponding to a "current physical quantity". The pressure may serve as the current physical quantity as described in conjunction with the modifications. In case where the current physical quantity is the current key position, the current key velocity serves as the "rate of change of the physical quantity". The true key position or true key velocity is corresponding to a "true physical quantity", and the true key velocity or true key acceleration serves as a "rate of change of the true physical quantity".

The boxes 216/218 or 220/222 as a whole constitute the "first data processor", and the circles 204/206 form in combination the "second data processor". The boxes 204/208 as a whole constitute a "multiplier", and the circle 210 and pulse width modulator 30 form in combination a "signal modulator". The gains kx and kv are respectively equivalent to the "first gain" and the "second gain".

What is claimed is:

1. An automatic player musical instrument for producing tones, comprising:

an acoustic musical instrument including a tone generating sub-system for producing said tones, and plural motion propagating paths each having plural component parts connected in series to one another toward said tone generating sub-system and sequentially moved for specifying a pitch of the tone to be produced; and an automatic playing system including plural sensors respectively converting motion of predetermined component parts respectively incorporated in said plural motion propagating paths to detecting signals representative of a current physical quantity expressing said motion, a target state indicator for producing pieces of target data each representative of a target physical quantity and a rate of change of said target physical quantity for associated one of said predetermined component parts, plural actuators respectively associated with said plural motion propagating paths and selectively energized with driving signals so as selectively to cause the associated motion propagating paths to move, and plural feedback control loops connected between said plural sensors and said plural actuators and optimizing said driving signals, each of said plural feedback loops having a first data processor connected to one of said plural sensors and determining a true physical quantity and a rate of change of said true physical quantity on the basis of said current physical quantity, a second data processor connected to said target state indicator and said first data processor and determining a first difference between said target physical quantity and said true physical quantity and a second difference between said rate of change of said target physical quantity and said rate of change of said true physical quantity, a multiplier connected to said second data processor and respectively multiplying said first difference and said second difference by a first gain and a second gain so as to produce a first controlling signal and a second controlling signal, respectively, said first gain being fallen within a range between 0.5 and 2.0, said second gain being fallen within a range between 0.5 and 2.3, the ratio of said second gain to said first gain ranging from 1 to 3 and a signal modulator connected between said multiplier and said plural actuators and optimizing the driving signal on the basis of said first controlling signal and said second controlling signal.

2. The automatic player musical instrument as set forth in claim 1, in which said second gains ranges from 0.5 to 1.1, from 1.1 to 2.3, from 1.4 to 2.3, from 2.0 to 2.3, from 2.0 to 2.3 on the condition that said first gain is 0.5, 0.8, 1.1, 1.4 and 1.7, respectively, and said second gain is of the order of 2.0 on the condition that said first gain is of the order of 2.0.

3. The automatic player musical instrument as set forth in claim 1, in which plural position transducers serve as said plural sensors so as to detect a current position of one of said predetermined component parts, and said target state indicator determines a target position and a target velocity as said true physical quantity and said rate of change of said true physical quantity.

4. The automatic player musical instrument as set forth in claim 3, in which said first data processor normalizes said current position, and determines said rate of change of said true velocity through a differentiation on said true position.

5. The automatic player musical instrument as set forth in claim 1, in which plural velocity sensors serve as said plural sensors so as to determine a current velocity of one of said predetermined component parts, and said target state indicator determines a target position and a target velocity as said target physical quantity and said rate of change of said target physical quantity.

6. The automatic player musical instrument as set forth in claim 5, in which said first data processor normalizes said current velocity so as to obtain said rate of change of said true physical quantity, and determines said true physical quantity through an integration of a true velocity serving as said rate of change of said true physical quantity.

7. The automatic player musical instrument as set forth in claim 1, in which said signal modulator has an adder adding a value of said first controlling signal to a value of said second controlling signal, and a pulse width modulator connected to an output node of said adder and determining a duty ratio of said driving signal on the basis of the sum of said values.

8. The automatic player musical instrument as set forth in claim 1, in which a bias signal representative of a resistance of said plural actuators is supplied to said modulator so that said modulator takes said bias signal into account in the optimization of said driving signals.

9. The automatic player musical instrument as set forth in claim 1, in which a piano serves as said acoustic musical instrument.

10. The automatic player musical instrument as set forth in claim 9, in which said second gains ranges from 0.5 to 1.1, from 1.1 to 2.3, from 1.4 to 2.3, from 2.0 to 2.3, from 2.0 to 2.3 on the condition that said first gain is 0.5, 0.8, 1.1, 1.4 and 1.7, respectively, and said second gain is of the order of 2.0 on the condition that said first gain is of the order of 2.0.

11. The automatic player musical instrument as set forth in claim 9, in which strings serve as said tone generating sub-system, and a key, an action unit and a hammer form in combination each of said plural motion propagating paths.

12. The automatic player musical instrument as set forth in claim 11, in which said key serves as one of said predetermined component parts so that one of said plural sensors and one of said plural actuators are provided in association with said key.

13. An automatic player associated with a musical instrument, comprising:

plural sensors respectively converting motion of predetermined component parts of plural motion propagating paths incorporated in said musical instrument to detecting signals representative of a current physical quantity expressing said motion;

a target state indicator for producing pieces of target data each representative of a target physical quantity and a rate of change of said target physical quantity for one of said predetermined component parts;

plural actuators respectively associated with said plural motion propagating paths and selectively energized with driving signals so as selectively to cause the associated motion propagating paths to move for producing tones; and plural feedback control loops connected between said plural sensors and said plural actuators and optimizing said driving signals, each of said plural feedback loops having a first data processor connected to one of said plural sensors and determining a true physical quantity and a rate of change of said true physical quantity on the basis of said current physical quantity, a second data processor connected to said target state indicator and said first data processor and determining a first difference between said target physical quantity and said true physical quantity and a second difference between said rate of change of said target physical quantity and said rate of change of said true physical quantity, a multiplier connected to said second data processor and respectively multiplying said first difference and said second difference by a first gain and a second gain so as to produce a first controlling signal and a second controlling signal, respectively, said first gain being fallen within a range between 0.5 and 2.0, said second gain being fallen within a range between 0.5 and 2.3, the ratio of said second gain to said first gain ranging from 1 to 3, and a signal modulator connected between said multiplier and said plural actuators and optimizing the driving signal on the basis of said first controlling signal and said second controlling signal.

14. The automatic player as set forth in claim 13, in which said second gains ranges from 0.5 to 1.1, from 1.1 to 2.3, from 1.4 to 2.3, from 2.0 to 2.3, from 2.0 to 2.3 on the condition that said first gain is 0.5, 0.8, 1.1, 1.4 and 1.7, respectively, and said second gain is of the order of 2.0 on the condition that said first gain is of the order of 2.0.

15. The automatic player as set forth in claim 13, in which plural position transducers serve as said plural sensors so as to detect a current position of one of said predetermined component parts, and said target state indicator determines a target position and a target velocity as said true physical quantity and said rate of change of said true physical quantity.

16. The automatic player as set forth in claim 15, in which said first data processor normalizes said current position, and determines said rate of change of said true physical quantity through a differentiation.

17. The automatic player as set forth in claim 13, in which plural velocity sensors serve as said plural sensors so as to determine a current velocity of one of said predetermined component parts, and said target state indicator determines a target position and a target velocity as said target physical quantity and said rate of change of said target physical quantity.

18. The automatic player as set forth in claim 17, in which said first data processor normalizes said current velocity so as to obtain said rate of change of said true physical quantity, and determines said true physical quantity through an integration of a true velocity serving as said rate of change of said true physical quantity.

19. The automatic player as set forth in claim 13, in which said signal modulator has an adder adding a value of said first controlling signal to a value of said second controlling signal, and a pulse width modulator connected to an output node of said adder and determining a duty ratio of said driving signal on the basis of the sum of said values.

20. The automatic player as set forth in claim 13 in which a bias signal representative of a resistance of one of said plural actuators is supplied modulator so that said modulator takes said bias signal into account in the optimization of said driving signals.

21. An automatic player musical instrument for producing tones, comprising:

an acoustic musical instrument including a tone generating sub-system for producing said tones, and plural motion propagating paths each having plural component parts connected in series to one another toward said tone generating sub-system and sequentially moved for specifying a pitch of the tone to be produced; and an automatic playing system including plural sensors respectively converting motion of predetermined component parts respectively incorporated in said plural motion propagating paths to detecting signals representative of a current physical quantity expressing said motion, a target state indicator for producing pieces of target data each representative of a target physical quantity and a rate of change of said target physical quantity for associated one of said predetermined component parts, plural actuators respectively associated with said plural motion propagating paths and selectively energized with driving signals so as selectively to cause the associated motion propagating paths to move, and plural feedback control loops connected between said plural sensors and said plural actuators and optimizing said driving signals, each of said plural feedback loops having a first data processor connected to one of said plural sensors and determining a true physical quantity and a rate of change of said true physical quantity on the basis of said current physical quantity, a second data processor connected to said target state indicator and said first data processor and determining a first difference between said target physical quantity and said true physical quantity and a second difference between said rate of change of said target physical quantity and said rate of change of said true physical quantity, a multiplier connected to said second data processor and respectively multiplying said first difference and said second difference by a first gain and a second gain so as to produce a first controlling signal and a second controlling signal, respectively, and a signal modulator connected between said multiplier and said plural actuators and optimizing the driving signal on the basis of said first controlling signal and said second controlling signal.

* * * * *